US008196251B2

(12) United States Patent
Lynch

(10) Patent No.: US 8,196,251 B2
(45) Date of Patent: Jun. 12, 2012

(54) GUTTER CLEANING ROBOT

(75) Inventor: James Lynch, Georgetown, MA (US)

(73) Assignee: iRobot Corporation, Bedford, MA (US)

( * ) Notice: Subject to any disclaimer, the term of this patent is extended or adjusted under 35 U.S.C. 154(b) by 1213 days.

(21) Appl. No.: 11/847,331

(22) Filed: Aug. 29, 2007

(65) Prior Publication Data

US 2008/0264456 A1 Oct. 30, 2008

Related U.S. Application Data

(60) Provisional application No. 60/914,209, filed on Apr. 26, 2007.

(51) Int. Cl.
*E04D 13/076* (2006.01)

(52) U.S. Cl. ..... 15/236.04; 15/104.09; 700/245

(58) Field of Classification Search ..... 15/104.09, 15/236.04; 700/245
See application file for complete search history.

(56) References Cited

U.S. PATENT DOCUMENTS

| | | | | |
|---|---|---|---|---|
| 5,311,641 | A * | 5/1994 | Matsuura et al. | 15/406 |
| 6,187,105 | B1 * | 2/2001 | Matlschweiger | 134/8 |
| 6,471,271 | B1 | 10/2002 | Segal | |
| 6,964,077 | B2 * | 11/2005 | Kadinger et al. | 15/104.03 |
| 7,177,633 | B2 * | 2/2007 | Ishiwatari | 455/418 |
| 7,539,557 | B2 * | 5/2009 | Yamauchi | 700/245 |
| 7,886,399 | B2 * | 2/2011 | Dayton et al. | 15/236.04 |
| 7,926,141 | B2 * | 4/2011 | Dayton et al. | 15/23 |
| 7,979,945 | B2 | 7/2011 | Dayton et al. | |
| 2006/0289036 | A1 | 12/2006 | Hilton | |

FOREIGN PATENT DOCUMENTS

| | | |
|---|---|---|
| EP | 1916354 | 4/2008 |

* cited by examiner

*Primary Examiner* — Randall Chin
(74) *Attorney, Agent, or Firm* — Fish & Richardson P.C.

(57) ABSTRACT

A gutter cleaning robot can traverse rain gutters to agitate and remove debris. The gutter cleaning robot is equipped with a debris auger at a front end that contacts and ejects the debris, and has a drive system for propelling the gutter cleaning robot along the rain gutter. The debris auger can include a spiral screw or various other forms of auger, and may be interchangeable by the user so as to enhance the effectiveness of the gutter cleaning robot in various environments or modes of operation.

14 Claims, 36 Drawing Sheets

GUTTER CLEANING ROBOT

BACKGROUND

Rain gutters are widely installed along the rooftop eaves of millions of homes and sloped-roof buildings in North America, Europe, and other parts of the world. These rain gutters serve an important role in properly channeling water runoff to appropriate destinations such as storm water mains or drainage ponds. By diverting roof runoff away from the walls of a building, rain gutters also reduce structural damage that would otherwise be caused by the flow of rainwater onto the walls. In addition to rainwater, substantial amounts of debris (such as leaves, tree branches, silt runoff from roof shingles, and the like) tend to accumulate in rain gutters over time, which can eventually constrict or prevent any rainwater from flowing properly.

Various tools have been described for facilitating rain gutter cleaning. For example, U.S. Pre-grant Appln. Pub. 2006/0289036 (incorporated herein by reference) relates to an elongated pole that emits compressed gas to blow leaves out of a gutter. Similarly, U.S. Pat. No. 6,471,271 (incorporated herein by reference) relates to a mechanical device, also including an elongated pole, in which a pair of tongs mounted at the end of the pole are opened and closed by pulling a rope to thrash debris out of a gutter.

However, the manual tools set forth in those documents can cause the user to fatigue his or her arms from holding heavy poles up as high as twenty feet overhead when attempting to remove debris from a gutter. For example, the user must raise the manual gutter cleaning tool up to the rain gutter and keep it raised for the duration of the cleaning. Furthermore, it may not be possible for the user to ascertain whether any residual matted debris remains in the gutter after attempting a removal, because the rain gutter is typically too high above the user for any visual inspection to be feasible.

SUMMARY

In view of the above, as well as other considerations, presently disclosed is a mobile robot for cleaning debris from rain gutters (herein referred to as a "gutter cleaning robot"). The gutter cleaning robot includes a debris auger at a front end of the main body of the gutter cleaning robot, and moves forward along the gutter while motivating the debris auger to clear debris from the gutter being traversed. Accordingly, rain gutters may be effectively cleaned without requiring a user to manipulate strenuous overhead equipment and minimize climbing a ladder.

In accordance with a first example, a gutter cleaning robot may have a drive system for propelling the gutter cleaning robot along a rain gutter, and a debris auger detachably connected to the gutter cleaning robot for agitating debris out of the rain gutter.

The gutter cleaning robot may also have a chassis (also referred to herein as a main body) including a robot connector for mechanically driving the debris auger, and a debris auger connector disposed on the debris auger for interfacing with the robot connector.

The debris auger connector may include one or more connector concavities extending into the debris auger connector, each connector concavity being aligned substantially parallel to a longitudinal axis of the debris auger connector, in which the robot connector includes one or more tines each arranged to extend into a respective connector concavity of the debris auger connector. Also, the robot connector may further include a locking collar concavity, in which the debris auger further includes a shroud disposed around the debris auger connector, the shroud provided for enveloping the robot connector when the debris auger is attached to the main body of the gutter cleaning robot, in which the shroud includes a locking protrusion extending from an inner surface of the shroud for engaging the locking collar concavity of the robot connector.

In the gutter cleaning robot, the debris auger connector may include a hexagonal concavity extending into the debris auger connector, the hexagonal concavity aligned substantially parallel to a longitudinal axis of the debris auger connector, in which the robot connector includes a hexagonal protrusion for extending into the hexagonal concavity of the debris auger connector. The debris auger may be interchangeable with one or more alternative debris augers; and/or may include a spiral screw for drilling into debris. The alternative debris augers may include a flail-type auger, a bristle-type auger, a flap-type auger, a twisting flap-type auger, an irregular protrusion-type auger, a revolving horizontal tines-type auger, a screw-and-flap-type auger, and/or a plow-type auger; and further, the debris auger may include a pneumatic tube for blowing air onto the debris.

The drive system of the gutter cleaning robot may include a caterpillar tread for contacting an interior surface of the rain gutter; and may also include a drive motor, at least two front wheels disposed on opposite lateral sides of the main body of the gutter cleaning robot for guiding the gutter cleaning robot along the rain gutter, and two rear wheels disposed on opposite lateral sides of the main body of the gutter cleaning robot and operably connected to the drive motor.

The gutter cleaning robot may also be usable with a remote control for operating the gutter cleaning robot via a wireless signal transmitted to the gutter cleaning robot.

The gutter cleaning robot may include a light emitting diode on the remote control that blinks when the remote control transmits a signal; and/or another emitting diode on the gutter cleaning robot that blinks when the gutter cleaning robot receives a signal. The gutter cleaning robot may also have a detachable handle or a tote loop disposed on the main body of the gutter cleaning robot for hanging onto a positioning hook that can hoist the gutter cleaning robot into the rain gutter; and/or an ammeter for monitoring an auger current supplied to the debris auger motor, and a controller for receiving input from the ammeter and controlling the drive motor and the debris auger motor, in which the controller can modulate the drive motor when the auger current exceeds a threshold value.

DETAILED DESCRIPTION

Figure 1A:
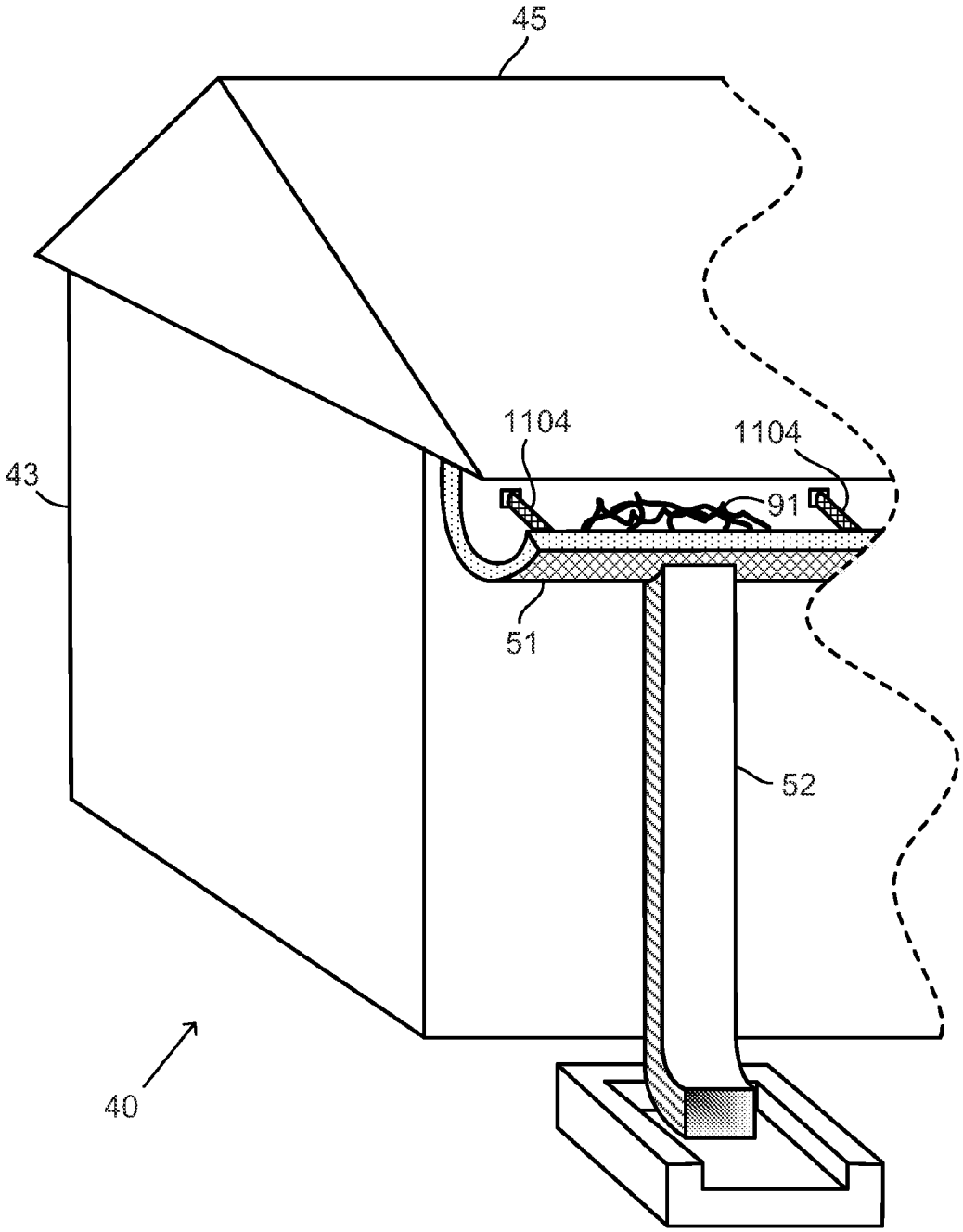
FIG. 1A is a perspective view of a house having a rain gutter and drainpipe.

FIG. 1A shows a house 40 having a roof 45 supported by walls 43. The roof 45 is sloped and includes tar shingles, cedar shakes, or another roof-building material. A rain gutter 51 is disposed along the eaves of the roof 45. Also, a drain spout 52 drains water from the gutter 51 via a hole in the bottom of the gutter 51. As rain or other water falls on the roof 45, the rainwater slides down to the eaves where it collects in the gutter 51 and flows down through the drain spout 52.

Figure 1B:
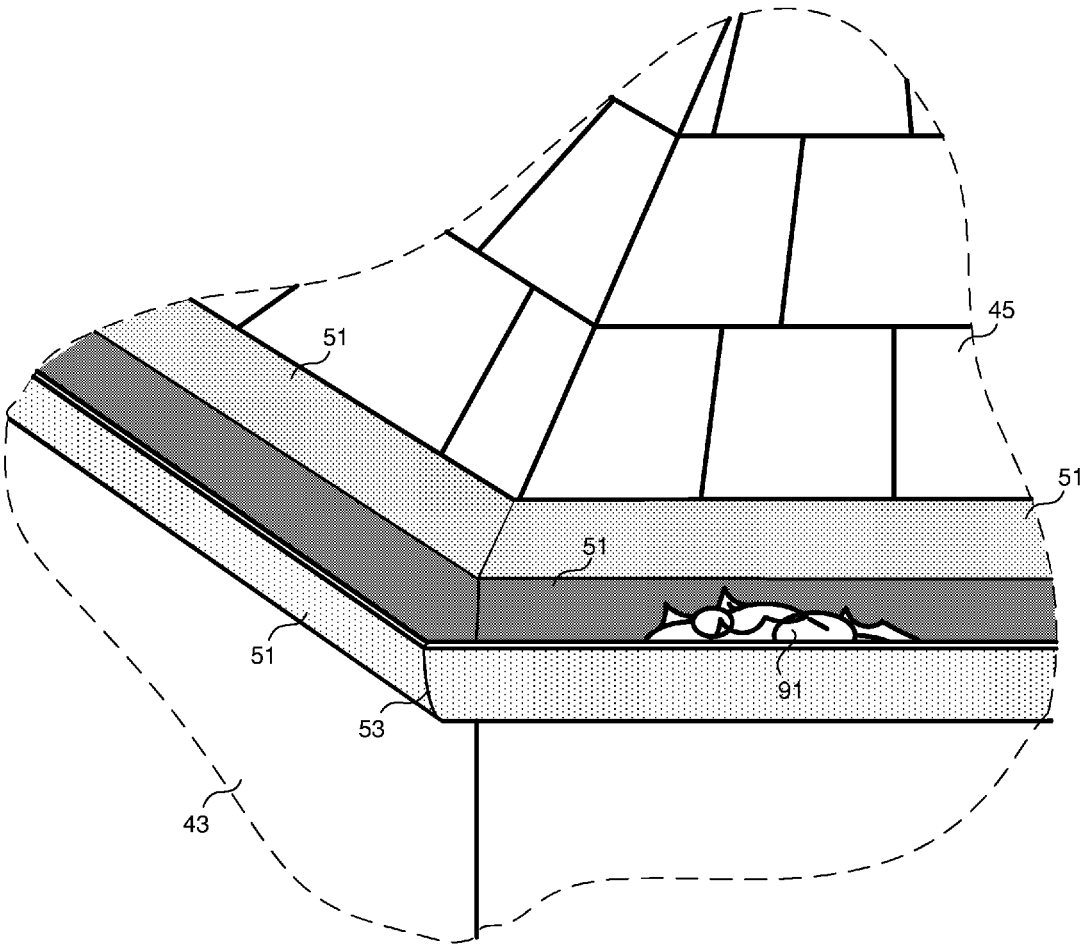
FIG. 1B is a detail view of a corner of the rain gutter shown in FIG. 1A.

Another example of a roof having a rain gutter is shown in FIG. 1B, in which the rain gutter 51 includes a corner 53 where two straight sections are joined. Debris 91 also collects in the gutter 51, and includes material such as silt, leaves, branches, and other detritus.

Figure 22:
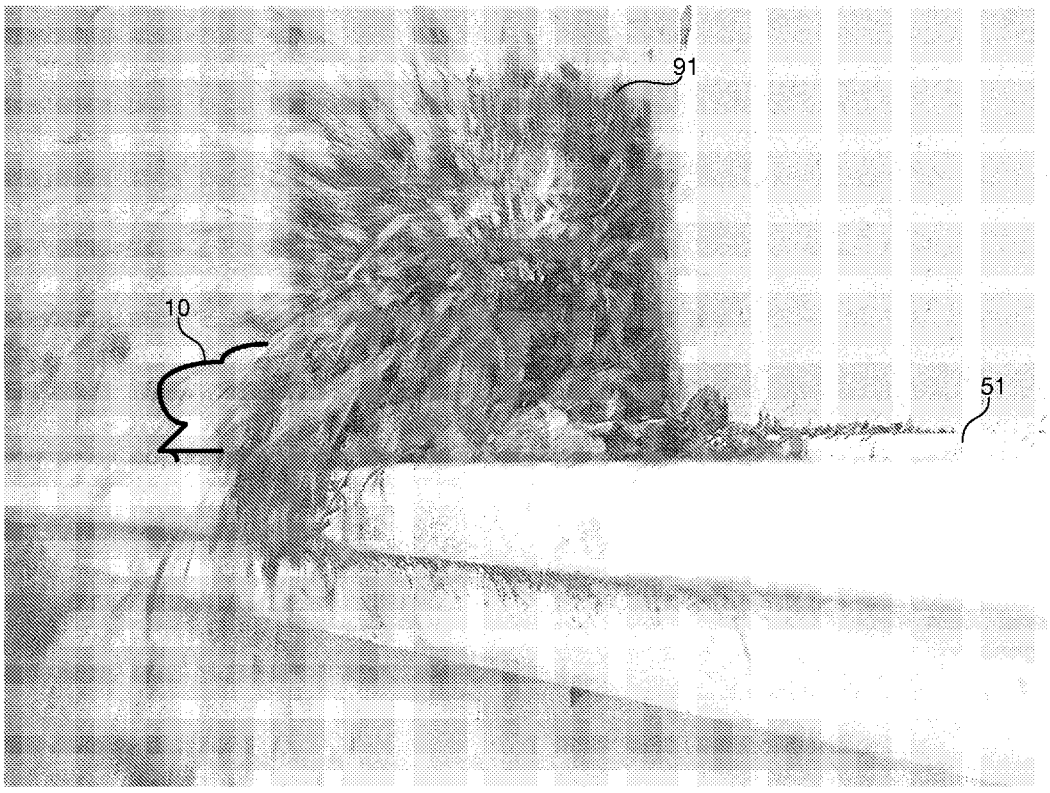
FIG. 22 is a photograph illustrating debris being ejected from a gutter by a gutter cleaning robot.

FIG. 22 illustrates a gutter cleaning robot 10 traversing the gutter 51. As the gutter cleaning robot 10 moves forward through the gutter 51, the gutter cleaning robot 10 ejects debris 91 out from the gutter 51.

Figure 2:
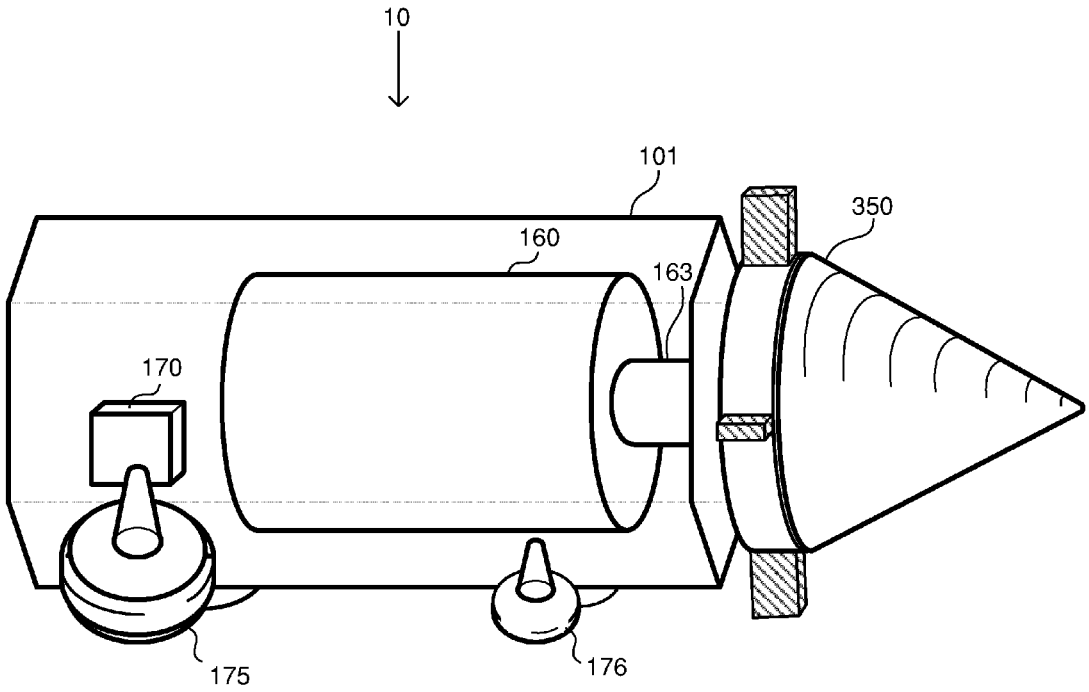
FIG. 2 is a partial cutaway view of a gutter cleaning robot.

In accordance with a first embodiment, FIG. 2 shows a gutter cleaning robot 10 for traversing the gutter 51 and clearing debris 91. The gutter cleaning robot 10 includes a main body 101 onto which rear drive wheels 175 are disposed, as well as two front wheels 176. A drive motor 170, such as a DC brushed or brushless motor with encoders, provides motivating force to rotate the rear wheels 175, which may preferably be aligned in an oblique orientation so as to contact the interior side walls of the gutter 51 rather than only the bottom interior surface thereof. The power output of the drive motor 170 may be transmitted directly to the treads 179 or wheels 175; or, alternatively, a reducing mechanical transmission may be interposed between the drive motor 170 and the treads 179 or wheels 175. The gutter cleaning robot 10 also includes a detachable debris auger 350 for agitating or moving the debris 91.

The debris auger 350 is connected to a debris auger motor 160 within the main body 101 via a debris auger shaft 163. The drive motor 170 and debris auger motor 160 are preferably controlled by an electronic controller having a memory store for storing computer instructions for controlling the drive motor 170 and/or the auger motor 160. In a preferred embodiment, a microcontroller serves as the electronic controller; or, in a possible alternative embodiment, the microcontroller may be a microprocessor. As a further alternative, the electronic controller may include a PLA or FPGA device.

Figure 1C:
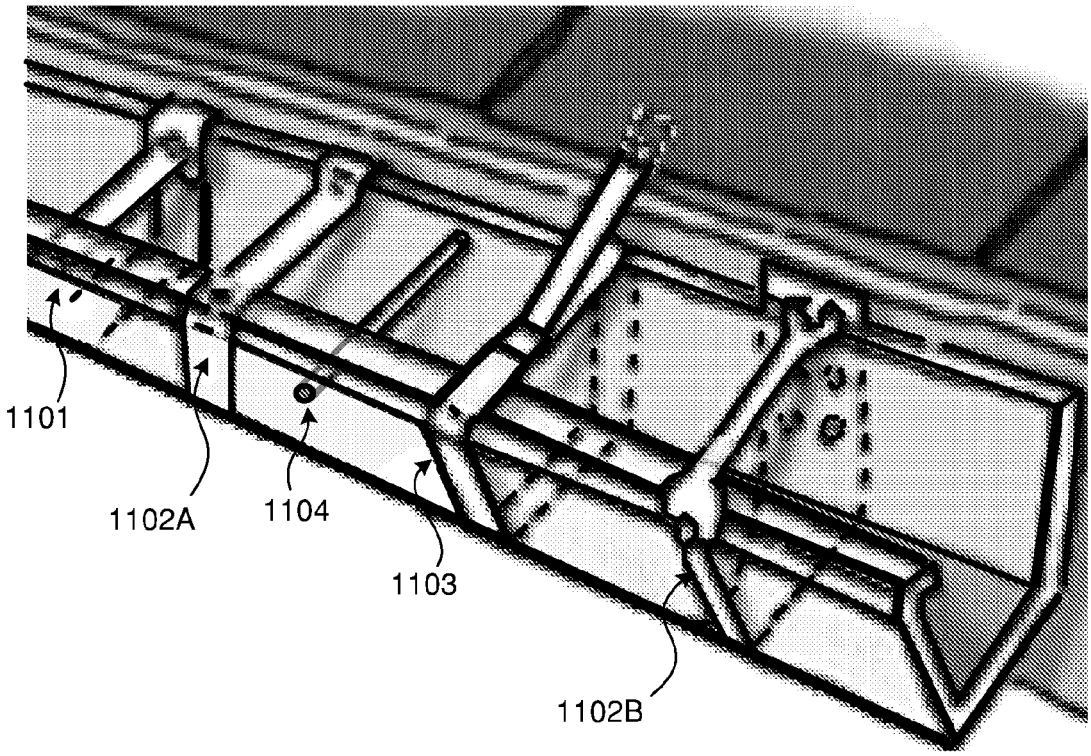
FIG. 1C is an oblique partial cutaway view of a rain gutter having four kinds of gutter hanging braces.

The gutter shown in FIG. 1C illustrates four common kinds of rain gutter hanging arrangements in which straps or braces are used. The inside hanger method employs straps 1101 spanning the width of the rain gutter 51, in which screws or nails go through the strap from inside the gutter into a fascia board at the edge of the roof. The outside hanger method uses outside hangers 1102A, 1102B mounted to the fascia board behind the rain gutter 51, and the rain gutter 51 is disposed on the outside hangers 1102A, 1102B. In the strap hanger method, straps 1103 are nailed under shingles into the roof sheathing. The spike and ferrule method uses spikes 1104 driven through the rain gutter 51 into the fascia board, in which ferrules are used to maintain the appropriate width of the gutter trough and to prevent the spikes 1104 from pulling against or distorting the rain gutter 51.

In each of the above-noted gutter hanging arrangements, a strap or spike crosses the trough of the gutter transversely, and presents a possible obstacle to any gutter cleaning robot 10 moving along the through of the rain gutter 51. Accordingly, in a preferred embodiment, the gutter cleaning robot 10 has an overall height profile that is low enough to afford sufficient clearance between the topmost part of the gutter cleaning robot 10 and the straps or spikes that cross over the trough of the rain gutter 51.

Figure 1D:
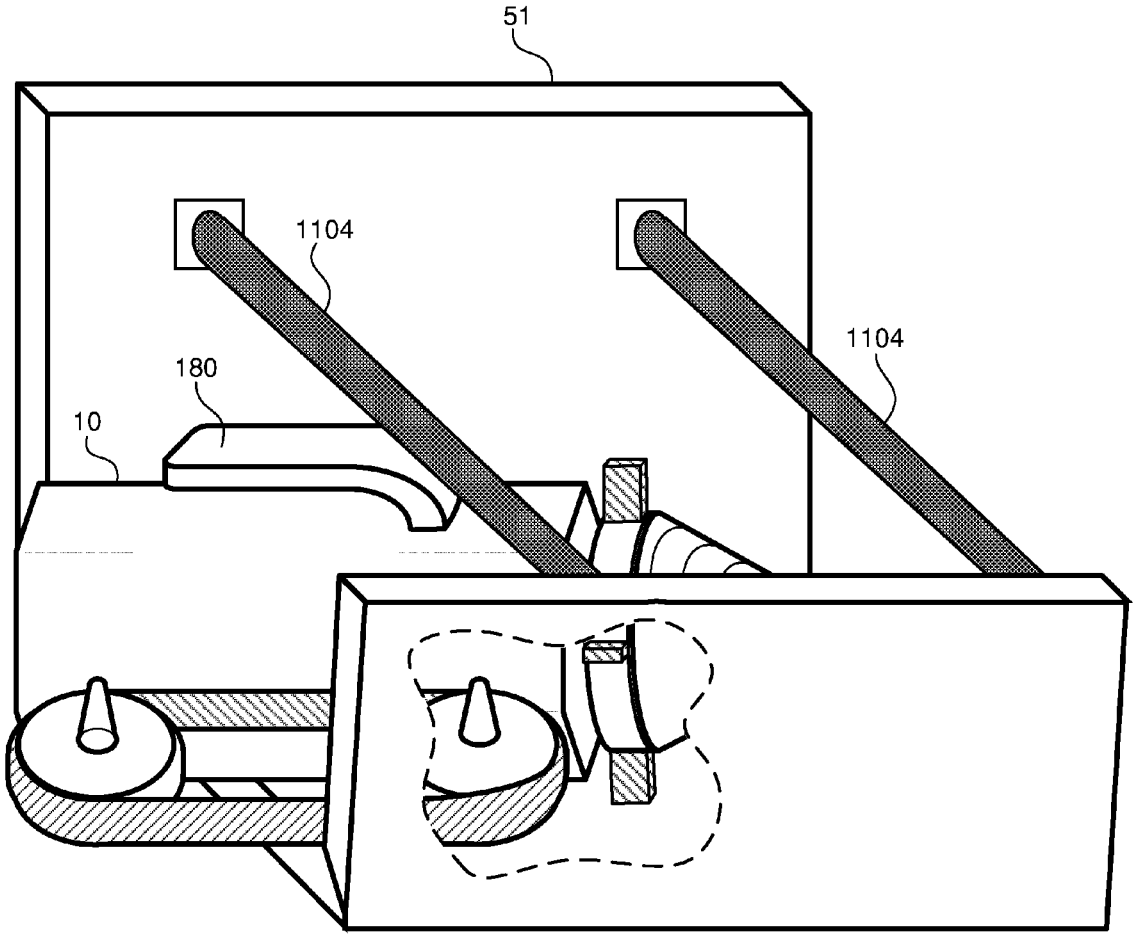
FIG. 1D is a partial cutaway view of a gutter cleaning robot traversing a rain gutter, in which the height of the gutter cleaning robot affords clearance to pass underneath a gutter hanging brace.
Figure 24:
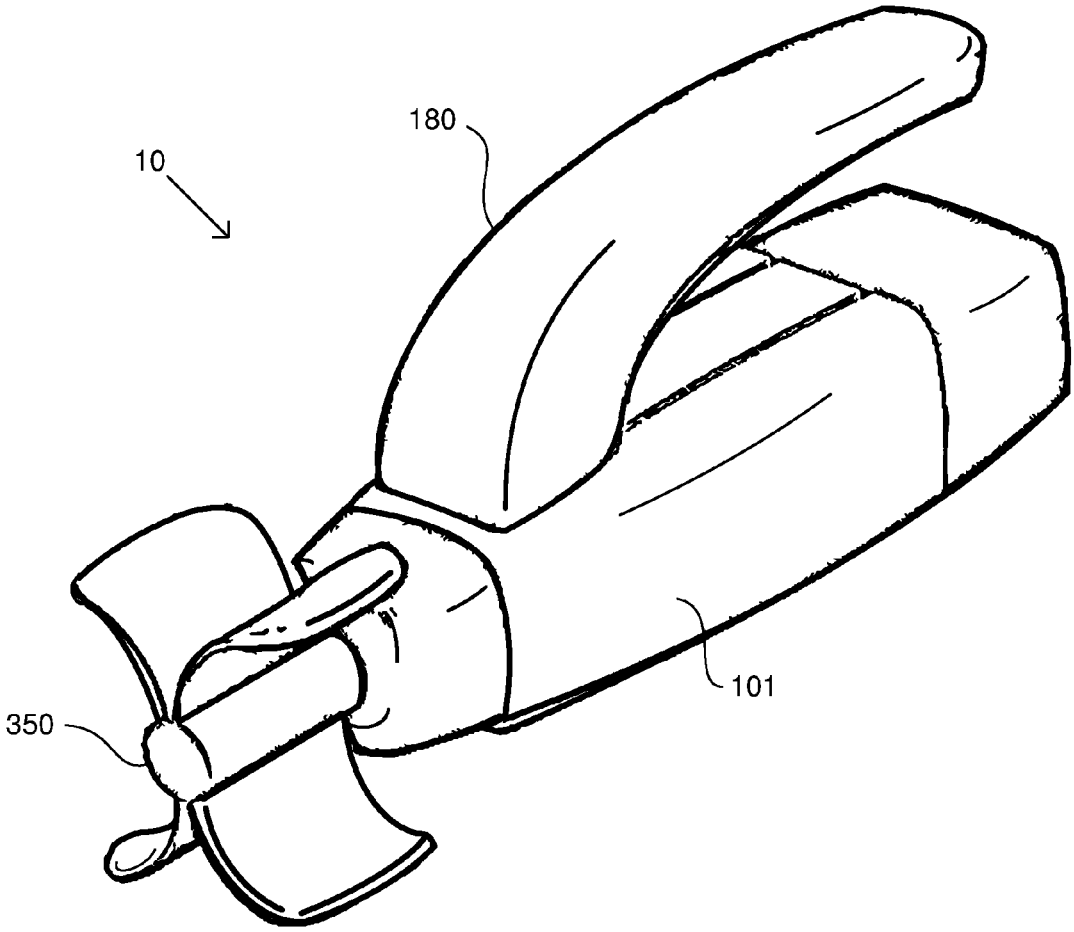
FIG. 24 is an oblique perspective view of a gutter cleaning robot having a removable handle.

As illustrated in FIG. 1D, for example, a gutter cleaning robot 10 includes a detachable handle 180 and caterpillar treads 179 that are disposed so as to permit the gutter cleaning robot 10 to pass underneath spikes 1104 that support the rain gutter 51. Another example of a gutter cleaning robot 10 including a detachable handle 180 is illustrated in FIG. 24. The detachable handle 180 facilitates handling and transportation of the gutter cleaning robot 10 by a user, and may be removed when the gutter cleaning robot 10 is operated in a rain gutter 51 having low overhead clearance. The detachable handle 180 may be fastened to the chassis 101 using a latch, wingnuts, magnets, velcro, or any other fastening arrangement suitable to permit attachment and removal of the detachable handle 180 to the gutter cleaning robot 10.

Many rain gutters 51 have either a round trough bottom or a substantially flat trough bottom. Rain gutters for residential housing typically have a width of between four to six inches, with the typical k-style gutter being five inches wide and the typical half-round gutter being six inches wide; thus, typical widths for rain gutters 51 may range between three to seven inches. The depth of many installed rain gutters 51 is approximately 75% the width of the rain gutter, and rain gutter depths typically range between about 60% to 90% of the width of the rain gutter. drain spouts commonly installed to rain gutters typically have 2×3", 3×4" or 4×5" rectangular cross-sections, and the rain gutters generally have rectangular holes of similar shape where they interface with the drain spouts.

The gutter cleaning robot 10 preferably has a width and caterpillar tread arrangement (or wheel, or other drive system) suitable to traverse rectangular hole of at least about three inches by four inches. The gutter cleaning robot 10 may alternatively have a width and drive system placement suitable to traverse holes having a width in the range of about two to five inches, and/or a length in the range of about two to six inches.

Many installed rain gutters 51 can support up to about 50 pounds per lineal foot. Accordingly, the gutter cleaning robot 10 preferably has a weight sufficiently low so as to be supported by the weight load capacity of common rain gutters, taking into account the weight of a typical load of debris 91.

Figure 3A:
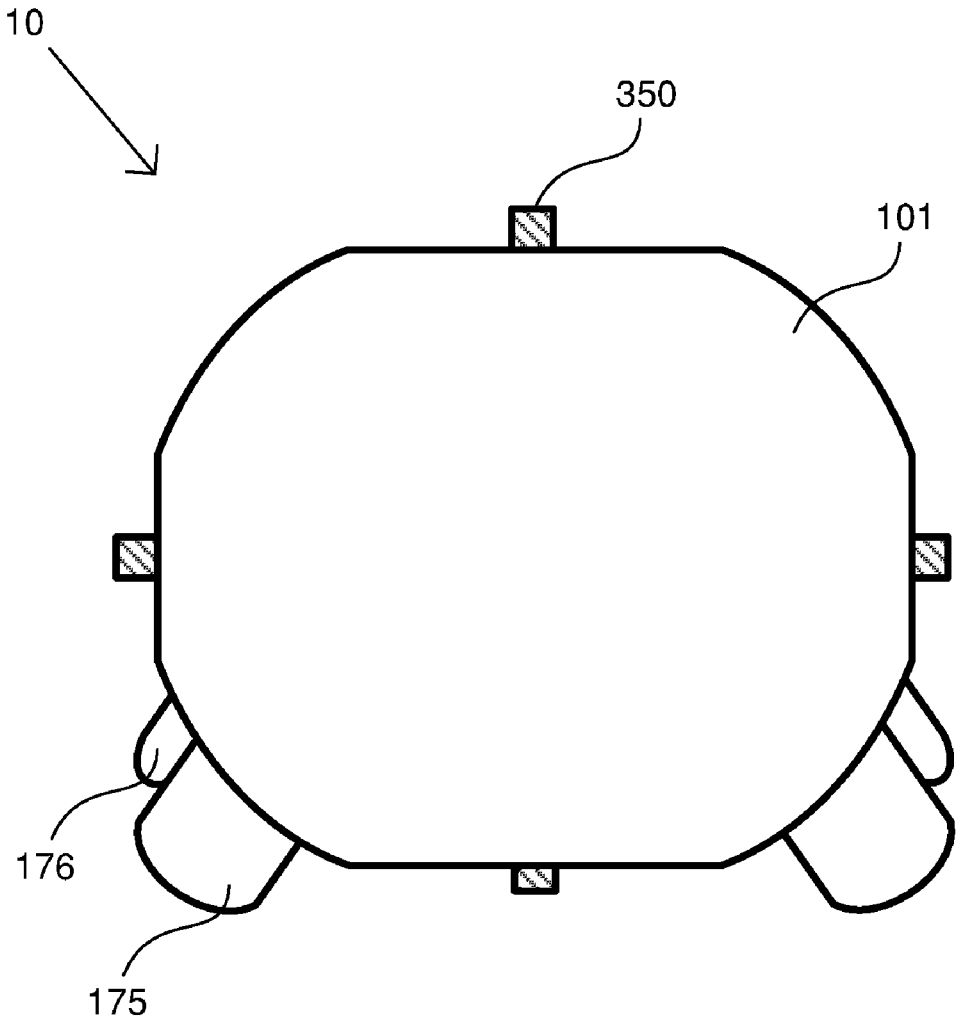
FIGS. 3A and 3B are front and rear aspect views, respectively, of the gutter cleaning robot shown in FIG. 2.
Figure 3B:
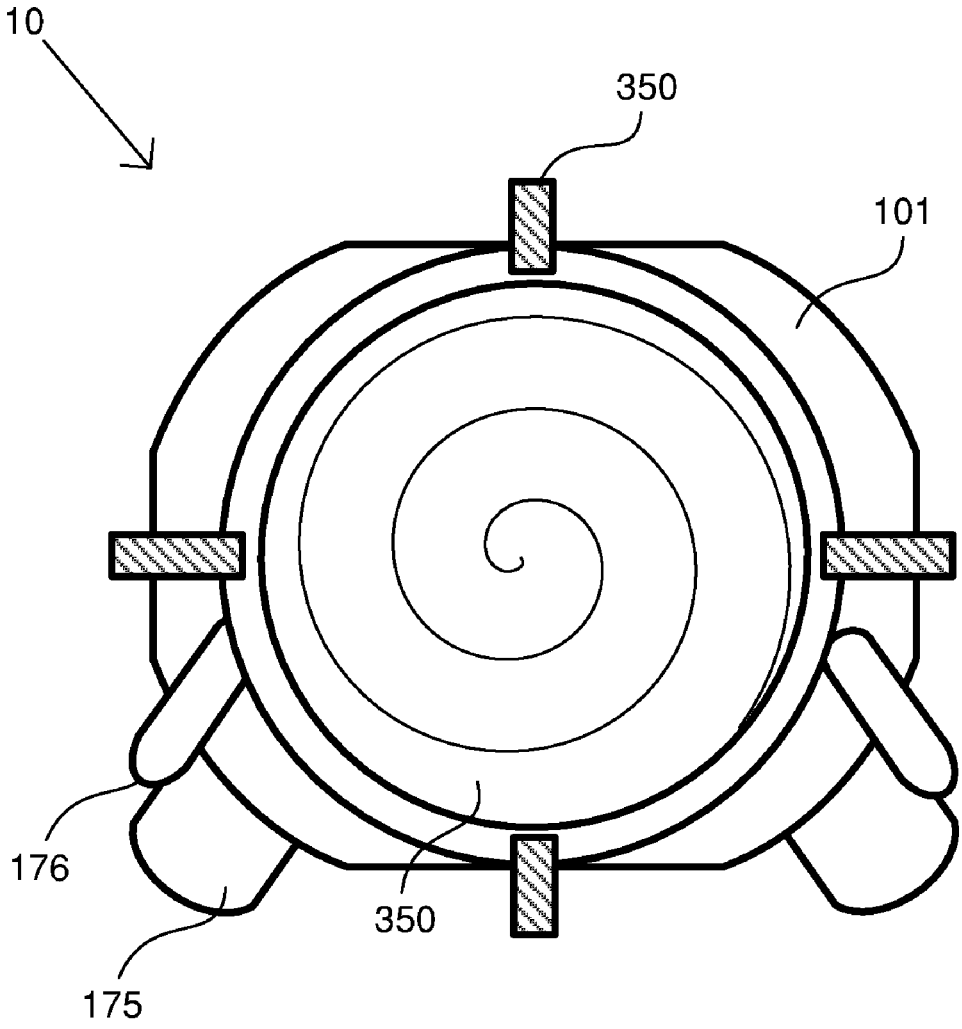
Figure 5:
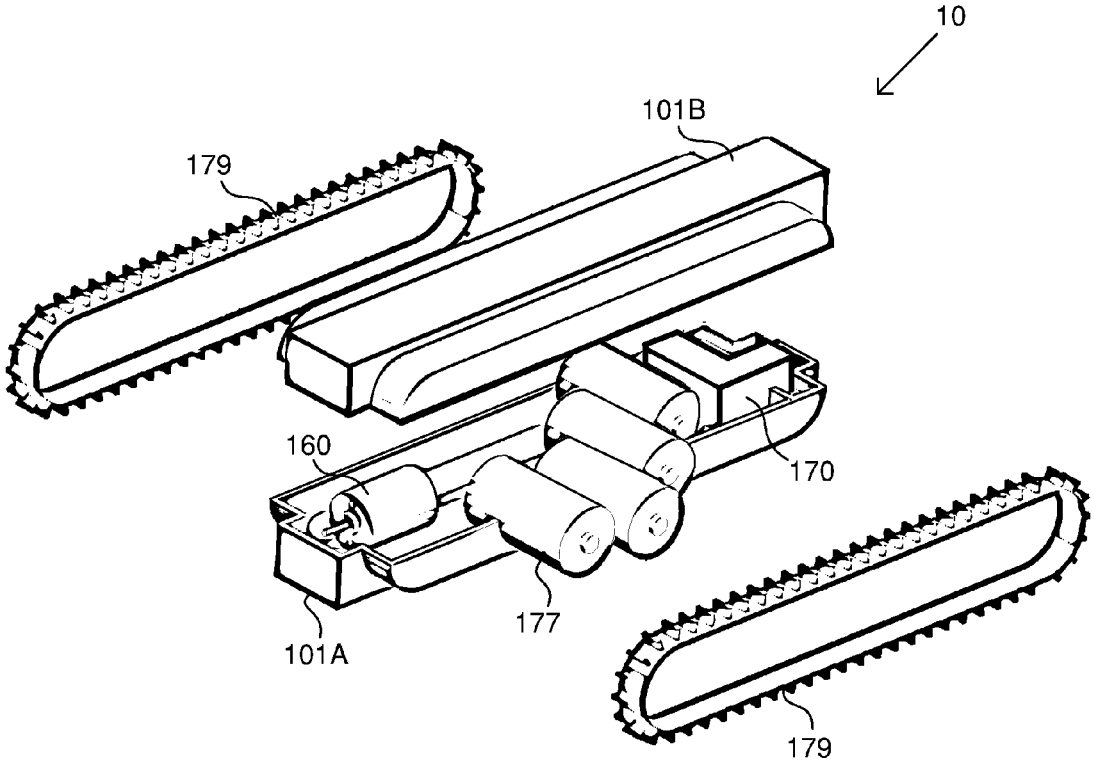
FIG. 5 is an exploded view of a gutter cleaning robot having a flattened profile, showing the placement of batteries and drive components within the chassis.
Figure 23:
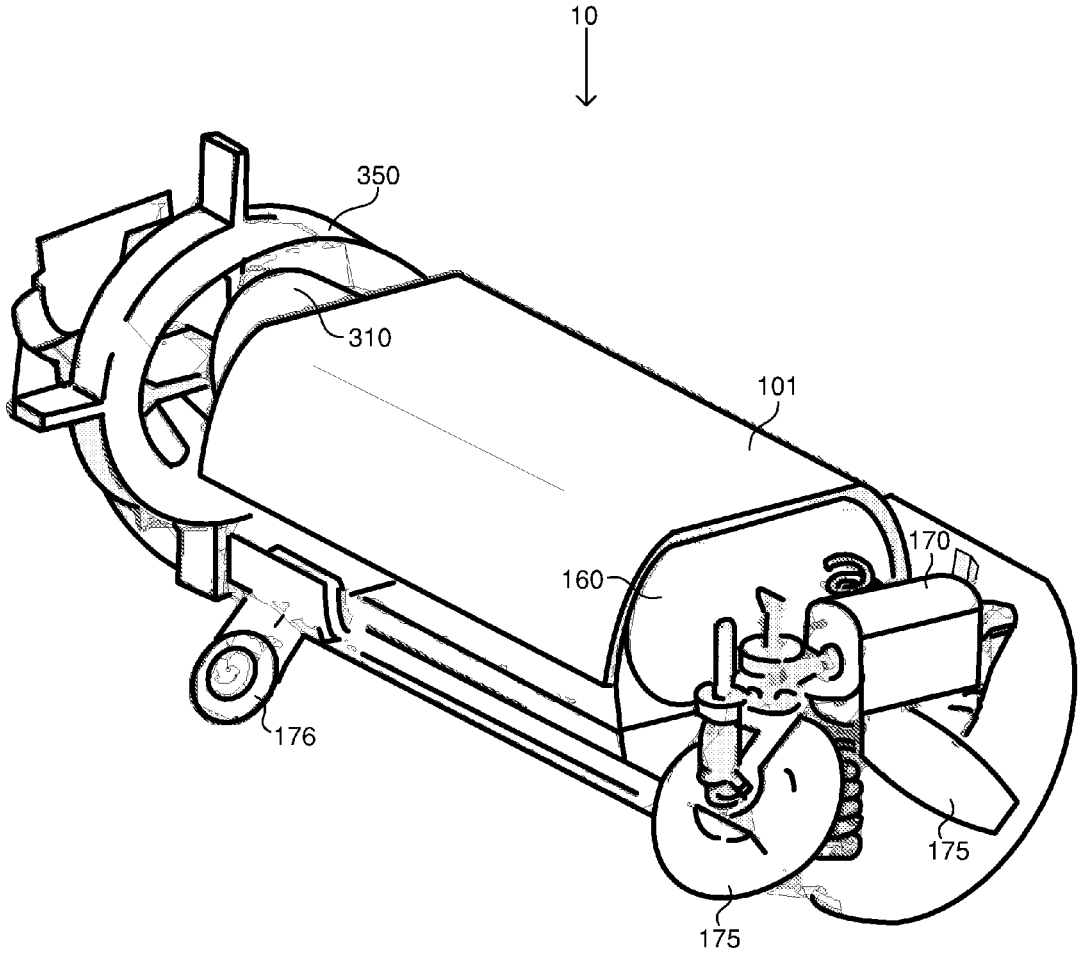
FIG. 23 is a partially transparent perspective view of a gutter cleaning robot having obliquely aligned rear drive wheels and a suspension.

FIG. 3A shows a rear aspect view of the gutter cleaning robot 10. In this example, the debris auger 350 has flaps, the end portions of which extend beyond the outer perimeter of the main body 101 and are thus visible. Also, FIG. 3B shows a front aspect view of the gutter cleaning robot 10. Because the gutter cleaning robot 10 may be required to traverse both flat-bottom rain gutters and round-bottom rain gutters, in a preferred embodiment the gutter cleaning robot 10 has a longitudinal cross-section having a substantially rounded bottom and a substantially flattened top, as illustrated in FIG. 5 or FIG. 23 (as non-limiting examples), in order to facilitate movement along either round-bottom or flat-bottom rain gutters while affording sufficient overhead clearance to permit the gutter cleaning robot 10 to pass underneath obstacles such as support braces. Alternatively, the gutter cleaning robot 10 may have other types of longitudinal cross-section outline such as a cylinder, rectangle, or other polygonal shape.

Figure 4:
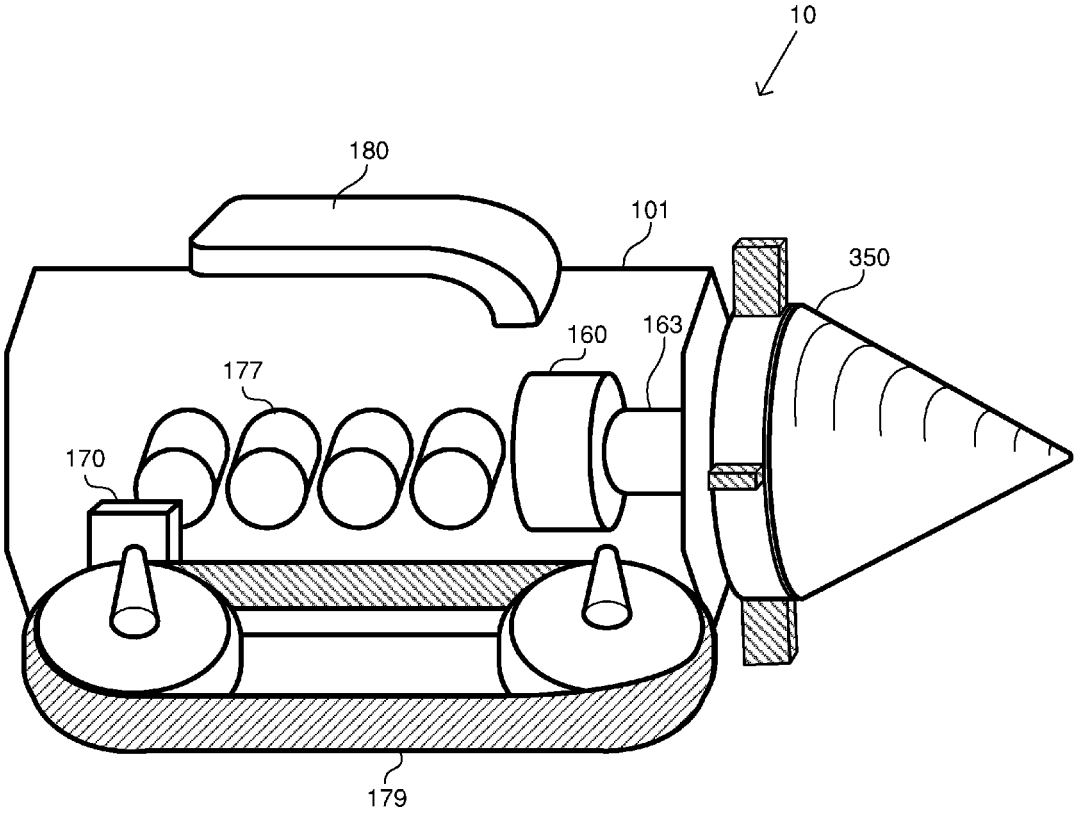
FIG. 4 is a schematic view of a gutter cleaning robot having caterpillar treads and a removable handle.

FIG. 4 illustrates an embodiment of a gutter cleaning robot 10 having caterpillar treads 179 as a traction drive and a removable handle 180 disposed on top of the chassis 101 of the gutter cleaning robot 51. In addition, batteries 177 are disposed within the chassis 101. The batteries 177 may include a single rechargeable cell, or include one or more commercially available cells, such as "D"-size alkaline cells, NiCd cells, nickel metal hydride cells, lithium cells, or any other kind of battery suitable for providing sufficient current and power the drive system 170 and auger 350 of the gutter cleaning robot 10.

In a preferred embodiment, the treads 179 or wheels 175 are disposed toward the edges of the gutter cleaning robot 10 so that they are separated horizontally by a distance of at least about 2 inches. Because drain spouts 52 often have a width in the range of about two to six inches, the wheels 175 or treads 179 are preferably disposed apart by a distance sufficient to enable the gutter cleaning robot 10 to straddle a hole while moving forward through a rain gutter 51. As an example, the horizontal distance between the wheels 175 or treads 179 may be chosen from a range extending from substantially two inches to substantially six inches.

The wheels 175 or treads 179 may be spring mounted to the chassis 101 of the gutter cleaning robot 10, to increase the traction pressure applied by the wheels 175 or treads against the side walls of the rain gutter 51. This increased traction pressure minimizes torsion caused by the action of the auger 350, and/or may further ensure that the gutter cleaning robot 10 remains within the rain gutter 51 during operation, such as when the gutter cleaning robot 10 is performing an escape behavior in response to becoming stuck.

In FIG. 5, a preferred embodiment is illustrated in which the gutter cleaning robot 10 includes caterpillar treads 179, and has a top chassis section 101B and a bottom chassis section 101A that house the drive system 170, batteries 177 and the auger motor 160. The batteries 177 are disposed substantially laterally in an in-line arrangement, so as to minimize the necessary height of the chassis sections 101A, 101B. The top and bottom chassis sections 101A, 101B are contoured so as to closely conform to the shape of the components housed therewithin, providing a compact, substantially flat profile of the assembled gutter cleaning robot 10. Accordingly, the height of the gutter cleaning robot 10 may be minimized, and overhead clearance optimized.

A typical clearance between the bottom-most point of a common rain gutter 51 and a fastening strap is 2.75 inches. Preferably, the gutter cleaning robot 10 has a maximum height and diameter of about 2.5 inches; or, alternatively, the gutter cleaning robot 10 may have a height and/or diameter up to substantially 2.75 inches, or to another distance representing the clearance from a rain gutter bottom to a fastening strap or brace.

A typical "D" size battery has a diameter of approximately 1.3465 inches. Thus where "D" size batteries are used, the gutter cleaning robot 10 preferably has a diameter equal to or slightly larger than the diameter of a standard D cell battery. For example, the gutter cleaning robot 10 may have a height of at least 1.4 inches. Alternatively, the gutter cleaning robot 10 may have a height and/or diameter within the range of between about 1.4 inches to about 2.5 inches; or a height and/or diameter of at least 1.4 inches, inter alia.

Figure 30A:
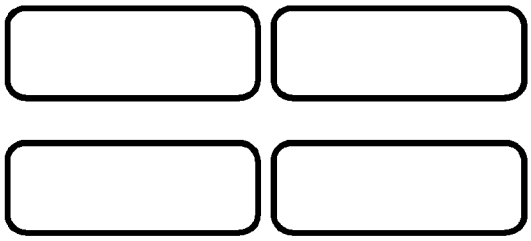
FIGS. 30A through 30D are schematic diagrams illustrating possible alignments of battery cells in a gutter cleaning robot chassis.
Figure 30B:
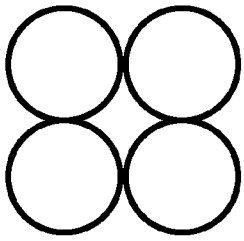
Figure 30C:
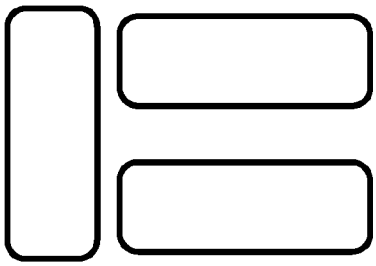
Figure 30D:
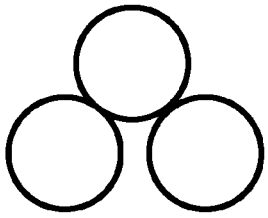

In one example, as shown in FIG. 4, a gutter cleaning robot 10 has a chassis 2.5 inches in diameter, and uses "D" size batteries 177 disposed within the chassis 101. Because the "D" size batteries 177 have a width of 1.3465 inches, no more than two "D" size batteries can be placed on top of the other, or else they will not fit within the chassis 101. Several example battery arrangements are illustrated in FIGS. 30A through 30D: FIG. 30A shows four batteries 177 arranged one battery high in a square pattern; FIG. 30B shows four batteries arranged squarely two batteries high, with two sets of two batteries next to each other and stacked on top of one another; FIG. 30C shows three batteries, in which first and second batteries are arranged horizontally aligned, one atop the other, and the third battery is disposed perpendicular to the other two batteries; and FIG. 30D shows three batteries arranged in a triangular pattern such that a first battery is disposed on top of second and third batteries placed side by side, all in horizontal alignment. In embodiments in which other types of batteries are used, the gutter cleaning robot 10 may have a height or diameter equal to or greater than at least the exterior diameter of that type of battery, for example.

The wheel 175 or tread 179 assembly may include a mechanical switch to determine whether the gutter cleaning robot 10 has fallen out of the rain gutter 51, or whether one of the wheels 175 is stuck in a hole. The switch is activated by a decrease in spring tension between the wheels 175 or treads 179 and the walls of the rain gutter 51. When the spring's tension is low enough to activate the mechanical switch, the gutter cleaning robot may alert the user and promptly cease powering the drive motor 170 and auger motor 160. This switch's state is preferably reset each time the gutter cleaning robot 10 is powered up, and may be ignored until after initialization. Furthermore, the switch is preferably only active when the gutter cleaning robot 10 is powered on; also, in at least one embodiment, a dip switch can be included on the gutter cleaning robot 10 to cause the gutter cleaning robot 10 to either monitor or ignore the switch.

Figure 6:
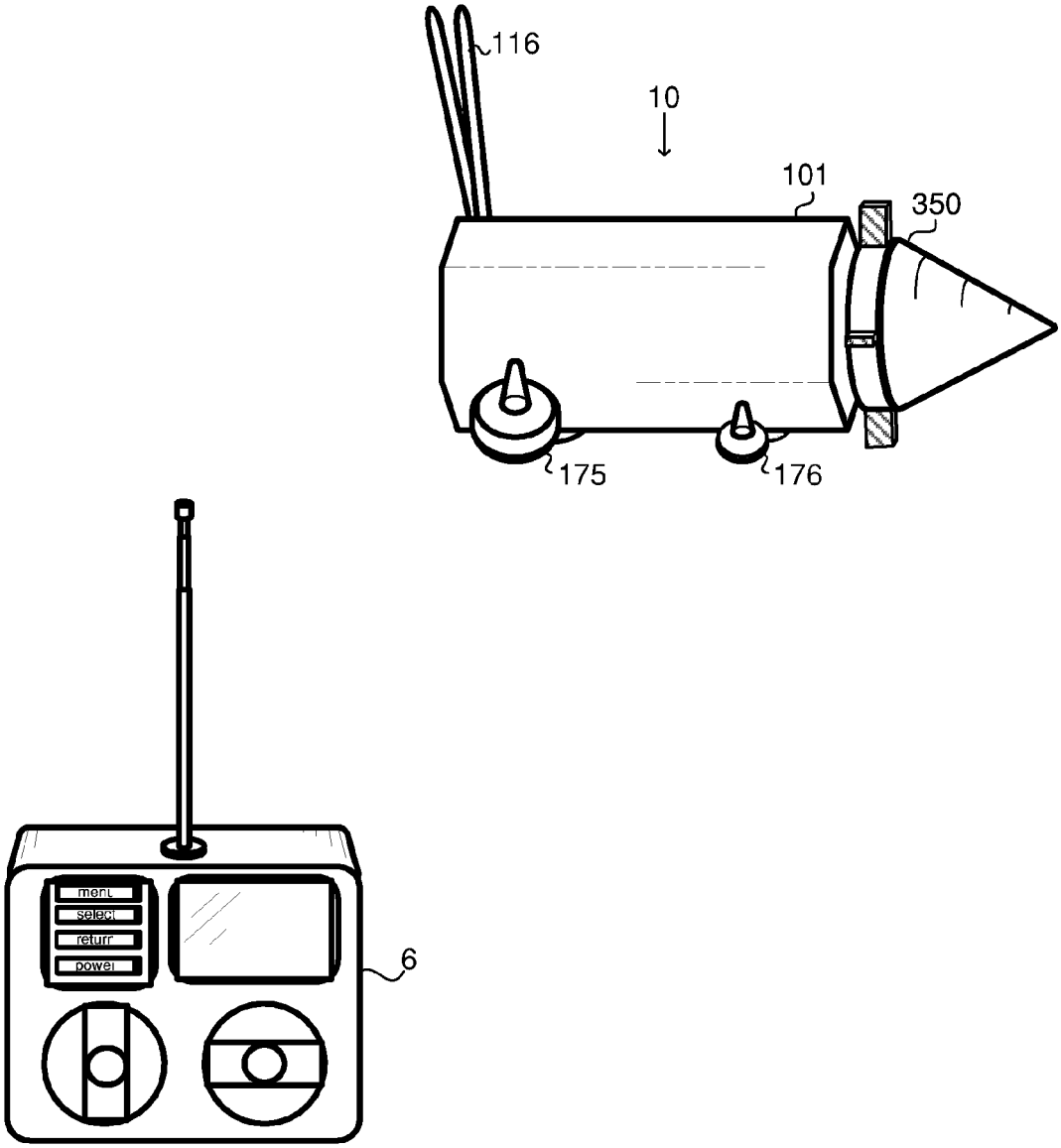
FIG. 6 is a diagram of a gutter cleaning robot operated by a wireless remote control.

The gutter cleaning robot 10 may be directed using a remote control 6, as shown in FIG. 6. The remote control 6 includes a joystick and/or buttons for entering commands to be sent to the gutter cleaning robot 10 (such as, for example, start/stop commands). The remote control 6 may transmit user-entered commands to the gutter cleaning robot 10 via radio frequency communication, which the gutter cleaning robot 10 receives via antennae 116. The remote control 6 and the gutter cleaning robot 10 may each include a respective light emitting diode (LED) or other visual or audible indicator, such as a light bulb or buzzer, for indicating when the remote control 6 is transmitting and/or when the gutter cleaning robot 10 is receiving a signal from the remote control 6. For example, when the remote control 6 is transmitting a signal, the LED on the remote control may blink; and/or when the gutter cleaning robot 10 receives a signal from the remote control 6, the LED on the gutter cleaning robot 10 may blink.

FIGS. 7A through 14B illustrate isometric views of various augers that may be interchangeably attached to the gutter cleaning robot 10. These debris augers may be replaced with another debris auger 350 when appropriate; for example, when matted debris is clogging a gutter, the user may affix a screw-type debris auger 350 to the gutter cleaning robot 10 for effectively penetrating the matted debris. Later, if the user desires not to drop debris 91 onto a walkway below the gutter 51 but instead to move the debris 91 to another portion of the gutter 51, the user can detach the screw-type debris auger 350 and then affix a plow-type debris auger 350 that can push the debris 91 rather than move it out of the gutter 51.

The auger 350 preferably has a diameter at least equal to the diameter of the chassis 101 of the gutter cleaning robot 10, as measured tip-to-tip. In one embodiment, the auger 350 has a diameter no greater than substantially 3 inches. Alternatively, the diameter of the auger 350 may be within the range of between about 2.5 inches to about 3.5 inches. The auger 350 preferably operates at a speed in the range of between about 1000 RPM (rotations per minute) to about 1500 RPM. The auger 350 may be made of a substantially flexible material, such as a polymer or plastic, that can deform when it comes into contact with rigid objects. Because the diameter of the auger 350 may exceed the clearance between the gutter's floor and a support strap or brace, the auger 350 may come into contact with straps or braces as the gutter cleaning robot 350 travels under the straps or braces. In order to ensure mobility, the auger 350 is preferably made of a material that deforms when it comes into contact with the type of strap or brace used to support the rain gutter 51.

Figure 7A:
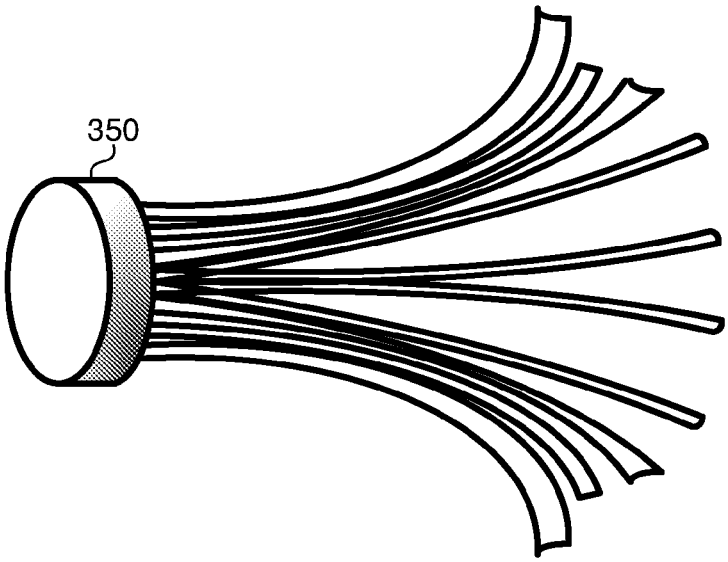
FIGS. 7A and 7B are isometric views of a debris auger 350 having flails.
Figure 7B:
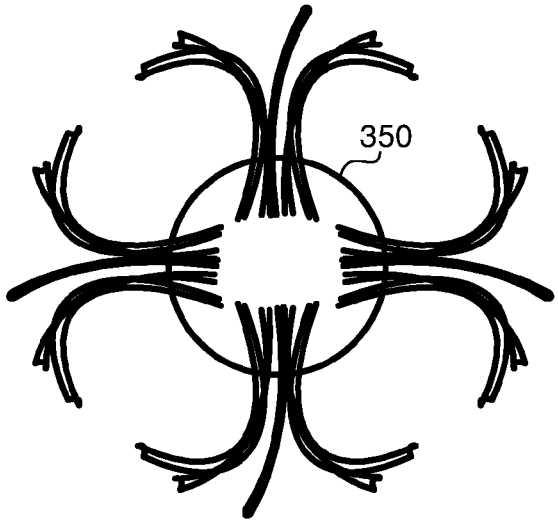

In FIGS. 7A and 7B, a flail-type debris auger 350 includes several flexible protruding flails. When the flail-type debris auger 350 is rotated under the power of the debris auger motor 160, the flails contact debris 91 and fling the debris 91 out of the gutter 51.

Figure 8A:
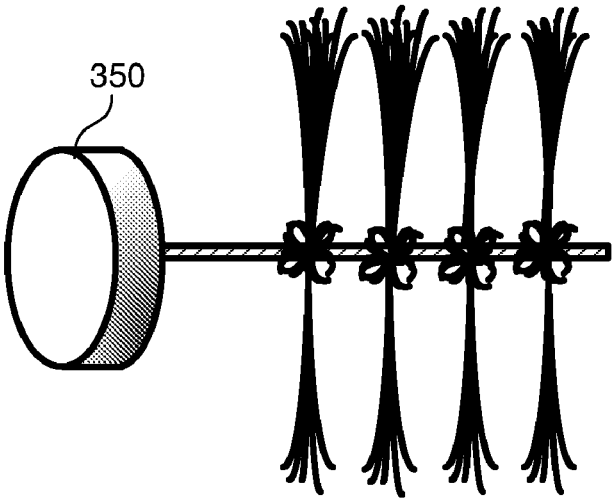
FIGS. 8A and 8B are isometric views of a debris auger 350 having bristles.
Figure 8B:
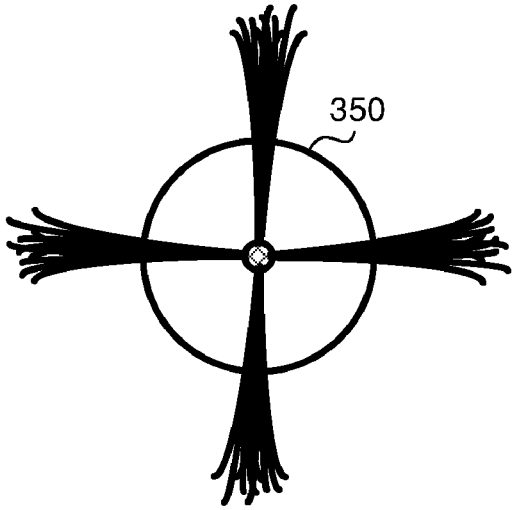

FIGS. 8A and 8B illustrate a brush-type debris auger 350 having several rows of bristles affixed to a central wire, similar to a pipe cleaner. The bristles rotate, thereby agitating debris 91 and moving it out of the gutter 51.

Figure 9A:
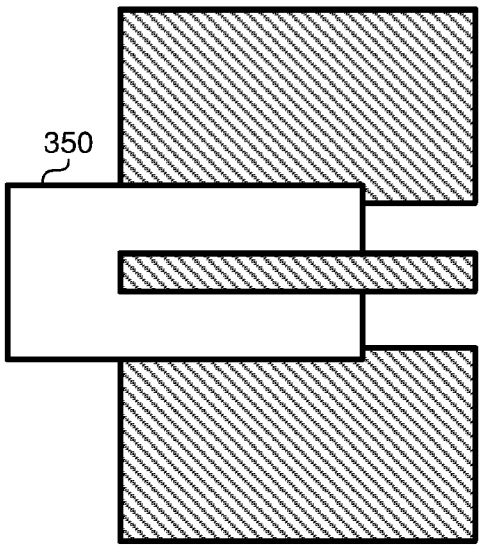
FIGS. 9A and 9B are isometric views of a debris auger 350 having longitudinal flaps.
Figure 9B:
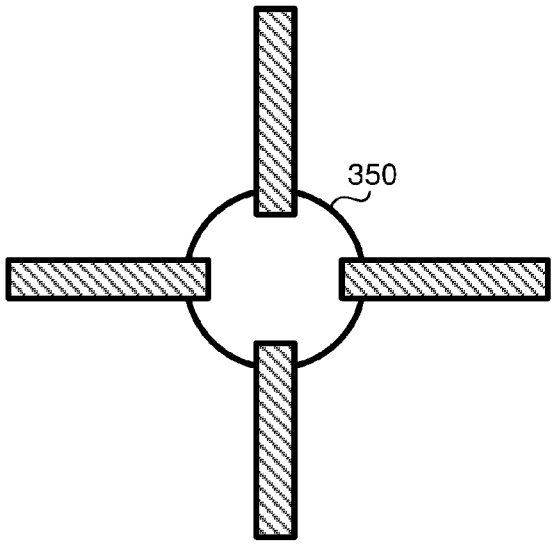

FIGS. 9A and 9B illustrate a flap-type debris auger 350 including flexible flaps centrally connected to a spool. The flaps may include a rubber or elastomeric material that adheres to debris 91, to effectively grab the debris 91 and facilitate removal of the debris 91 from the gutter 51.

Figure 10A:
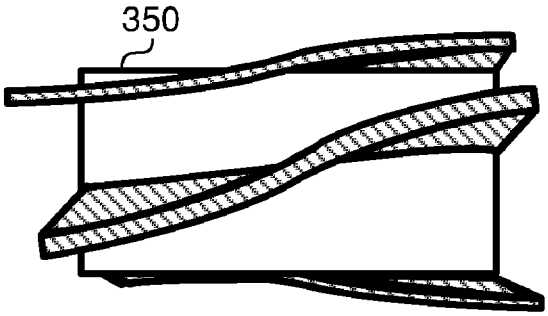
FIGS. 10A and 10B are isometric views of a debris auger 350 having oblique flaps.
Figure 10B:
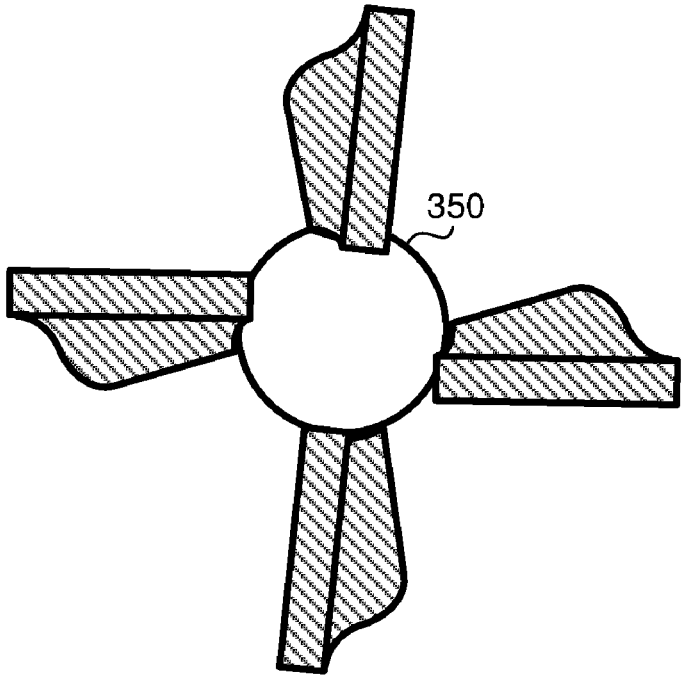

A twisting flap-type debris auger 350 is shown in FIGS. 10A and 10B. The twisting flap-type debris auger 350 may be similar to the flap-type debris auger 350 shown in FIGS. 9A and 9B, differing in that the flaps are connected along a twisting path to the central spool rather than in a straight (parallel to the longitudinal axis) arrangement.

Figure 11A:
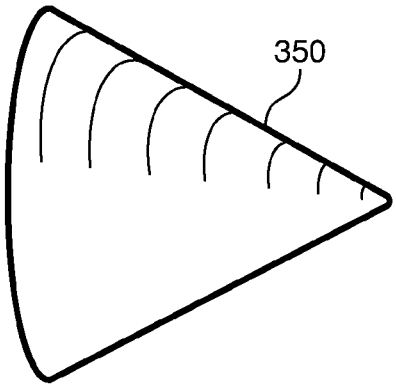
FIGS. 11A and 11B are isometric views of a debris auger 350 having a screw.
Figure 11B:
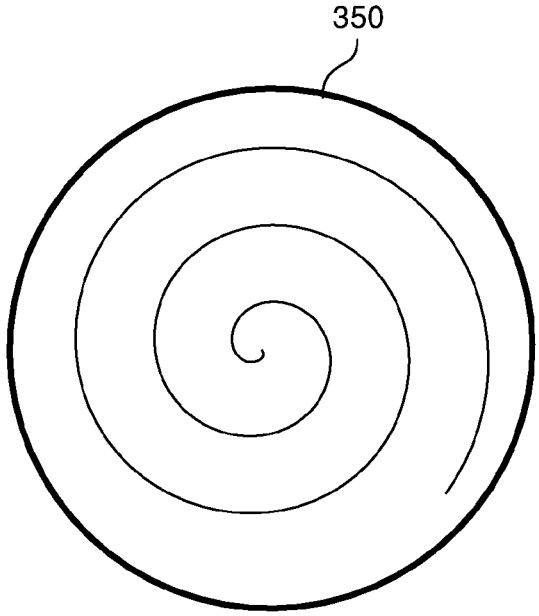

FIGS. 11A and 11B illustrate a screw-type debris auger 350. The screw-type debris auger 350 includes a conical spiral screw, similar to a drill bit, having screwed threading for effectively penetrating matted debris 91 and motivating loosened debris material out of the gutter 51.

Figure 12A:
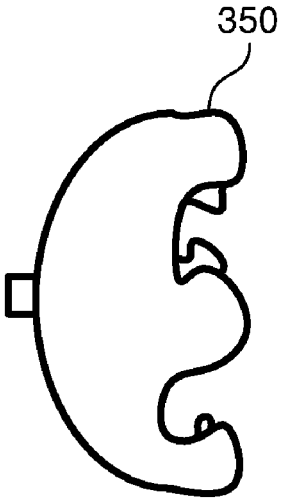
FIGS. 12A and 12B are isometric views of a concave debris auger 350 having rigid protrusions.
Figure 12B:
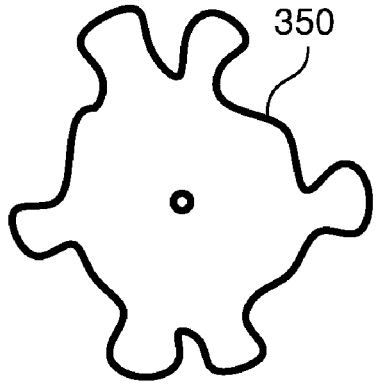

An irregular protrusion-type debris auger 350 is shown in FIGS. 12A and 12B, having a hemispherical portion from which irregular finger-like protrusions extend to effectively seize chunks of debris 91. The irregular protrusion-type debris auger 350 may have a form similar to a spaghetti mixer, as a non-limiting example.

Figure 13A:
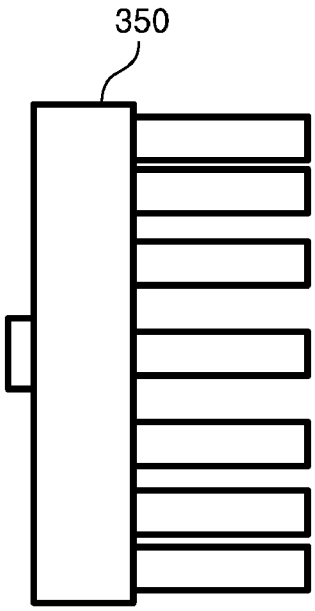
FIGS. 13A and 13B are isometric views of a debris auger 350 having rigid protrusions.
Figure 13B:
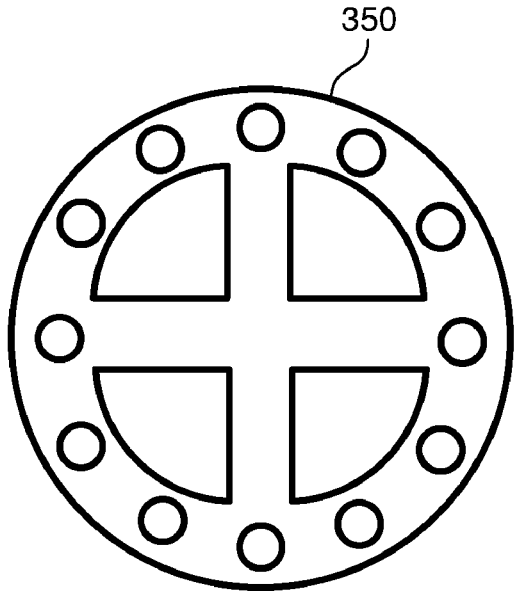

FIGS. 13A and 13B illustrate a horizontal tines-type debris auger 350 that has straight tines extending forward from a circular outer track. The tines, when revolving, can agitate large masses of debris 91.

Figure 14A:
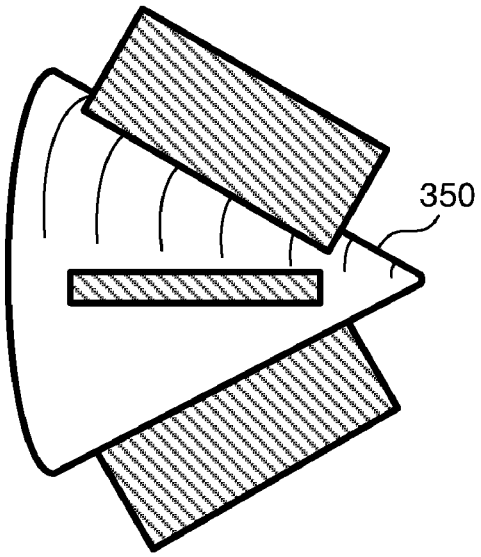
FIGS. 14A and 14B are isometric views of a debris auger 350 having flaps connected to a screw.
Figure 14B:
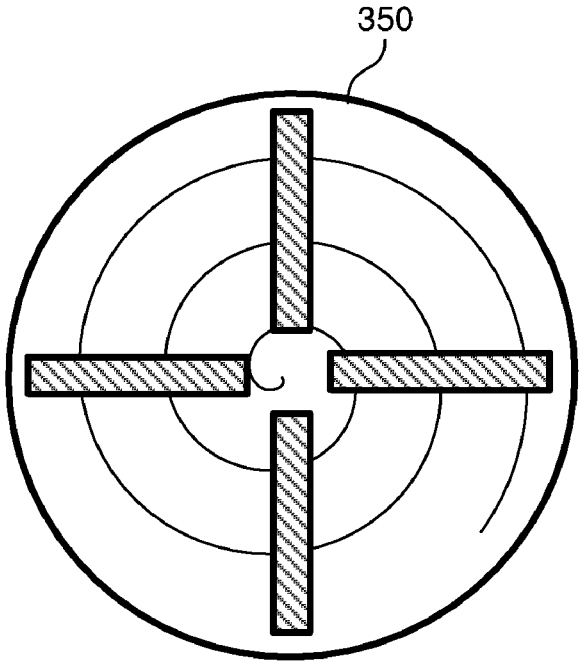
Figure 14C:
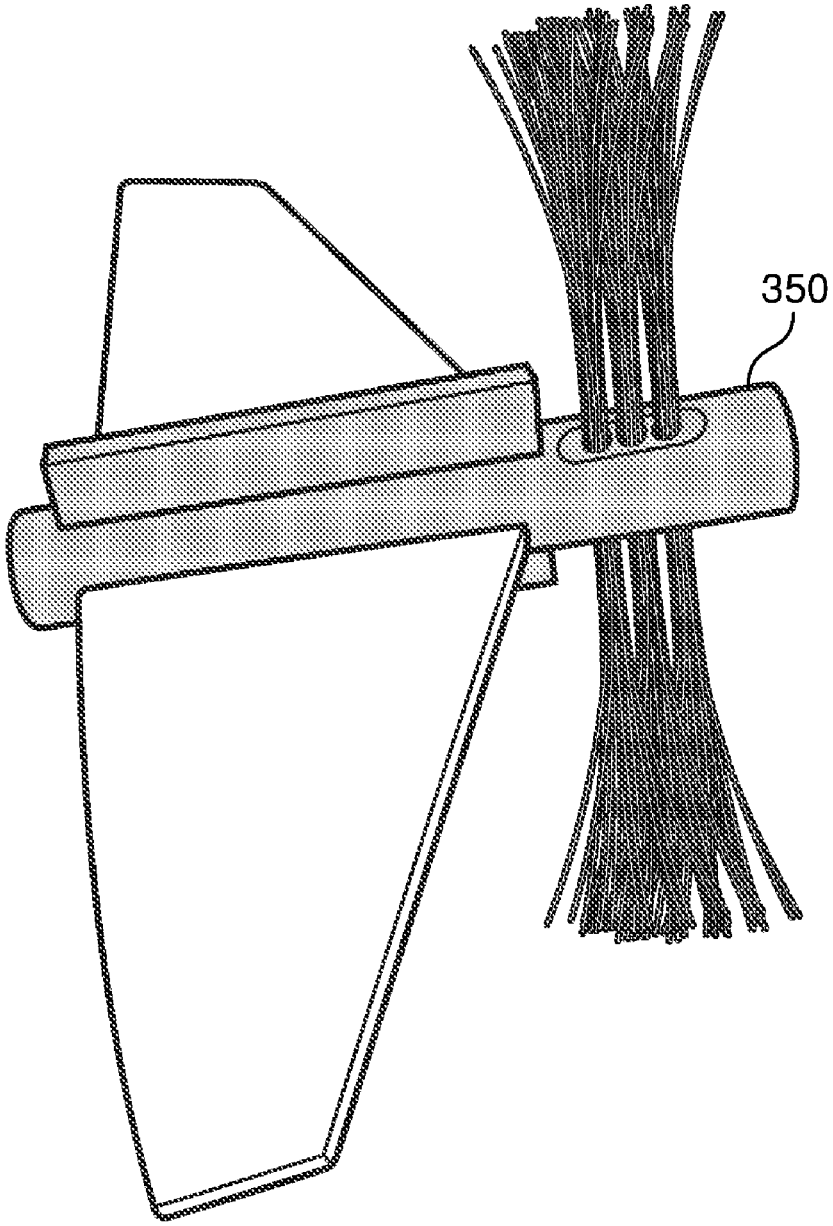
FIG. 14C is an oblique view of a debris auger 350 having flaps and a bristle, which is rotatable to eject debris.
Figure 14D:
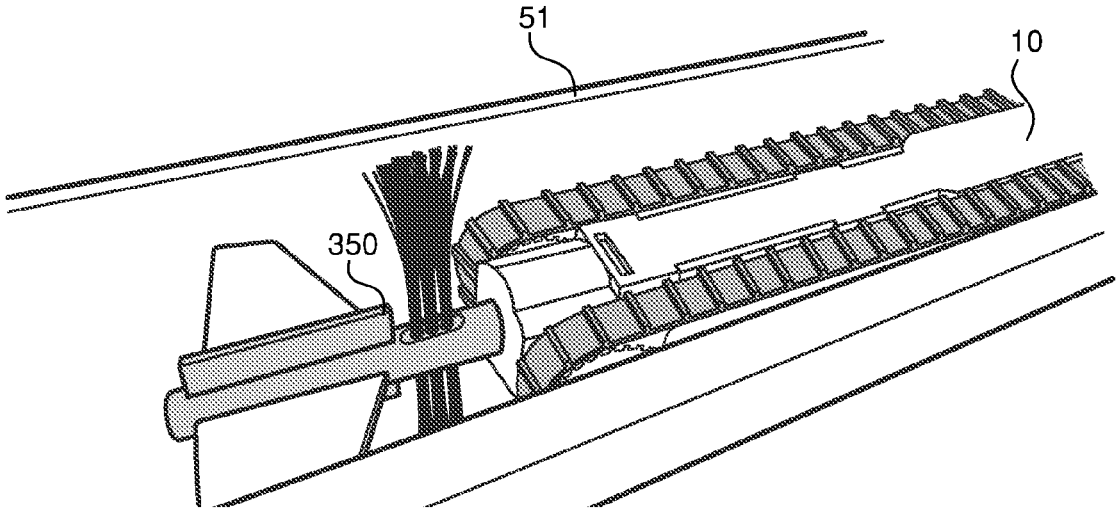
FIG. 14D is an oblique view of a robot 10 traversing a gutter 51 using the auger 350 of FIG. 14C.

FIGS. 14A and 14B illustrate an screw-and-flaps-type debris auger 350 combining the features of the screw-type debris auger 350 with the flaps of the flap-type debris auger 350. Accordingly, the screw-and-flaps-type debris auger 350 can both penetrate matted debris 91 and also seize granular debris 91 that may be agitated loose from the matted debris 91 during a cleaning operation of the gutter cleaning robot 10.

Although the debris augers shown in FIGS. 7A through 14B are illustrated as non-limiting examples, the varieties and types of debris augers are not limited thereto. As further non-limiting examples, FIG. 20 illustrates a pneumatic debris auger 350 and FIGS. 26A and 26B illustrate a plow-type debris auger 350.

Figure 20:
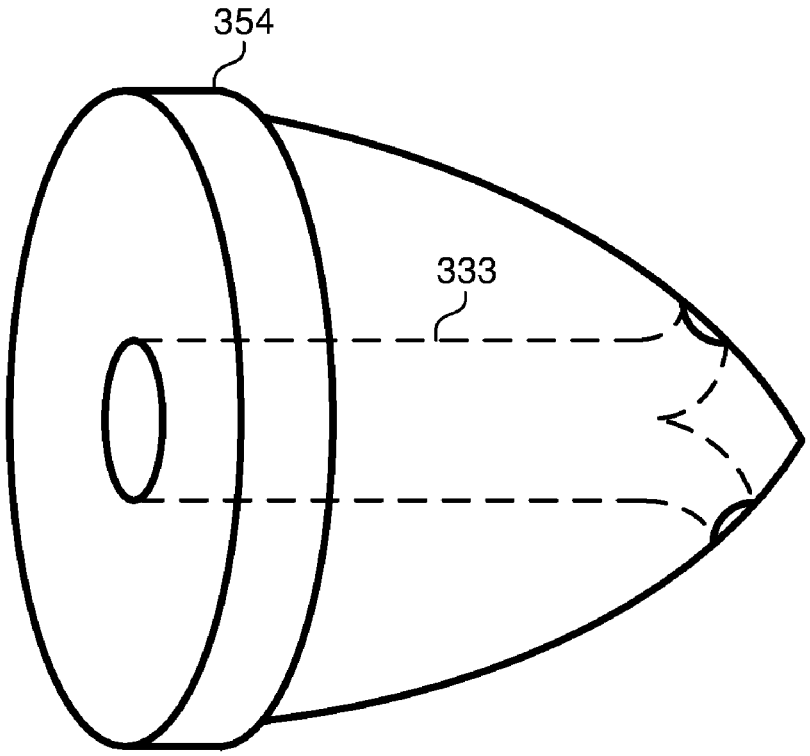
FIG. 20 is a partial cutaway profile view of a pneumatic debris auger 350.

The pneumatic-type debris auger 350 shown in FIG. 20 includes a conical portion that may include screwed threading like the screw-type debris auger 350 shown in FIGS. 11A and 11B, for example. In addition, the pneumatic-type debris auger 350 includes a hollow central passage 333 and openings 335 through which a fluid, such as pressurized gas (which may include air, nitrogen, helium, or any other suitable gas or combination of gases) or liquid may be passed. The pressurized air preferably emerges from the openings 335 at a velocity and rate of flow sufficient to agitate the debris 91. Accordingly, the breaking up of matted or chunky debris 91 is further enhanced by the action of the pressurized gas. Alternatively, pressurized liquid—such as water—may instead be passed through the central passage 333 and openings 335, and likewise applied to the debris 91. The pressurized liquid may include any suitable liquid, such as water or an aqueous cleaning solution (for example, detergents or surfactants dissolved in water); furthermore, the liquid may be heated above the ambient temperature, in order to aid in the break-up of leaf resin or tar and to promote agitation of the debris 91, for example.

Figure 26A:
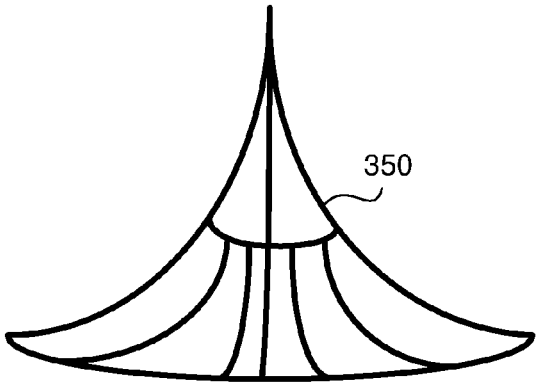
FIGS. 26A and 26B are isometric views of a plow-type debris auger.
Figure 26B:
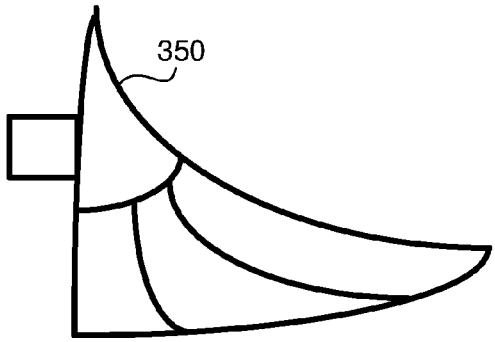

FIGS. 26A and 26B illustrate a plow-type debris auger 350 having a form similar to a cow-catcher. When the plow-type debris auger 350 is affixed to the gutter cleaning robot 10, the gutter cleaning robot 10 pushes the debris 91 forward through the gutter 51 instead of ejecting the debris 91 out of the gutter 51. This can be useful when the user prefers to avoid debris 91 from spilling onto a clean area of ground below the gutter 51, for example. After the debris 91 is pushed to a more appropriate section of the gutter 51, the user can exchange the plow-type debris auger 350 with another debris auger 350 for ejecting the debris 91.

Figure 21:
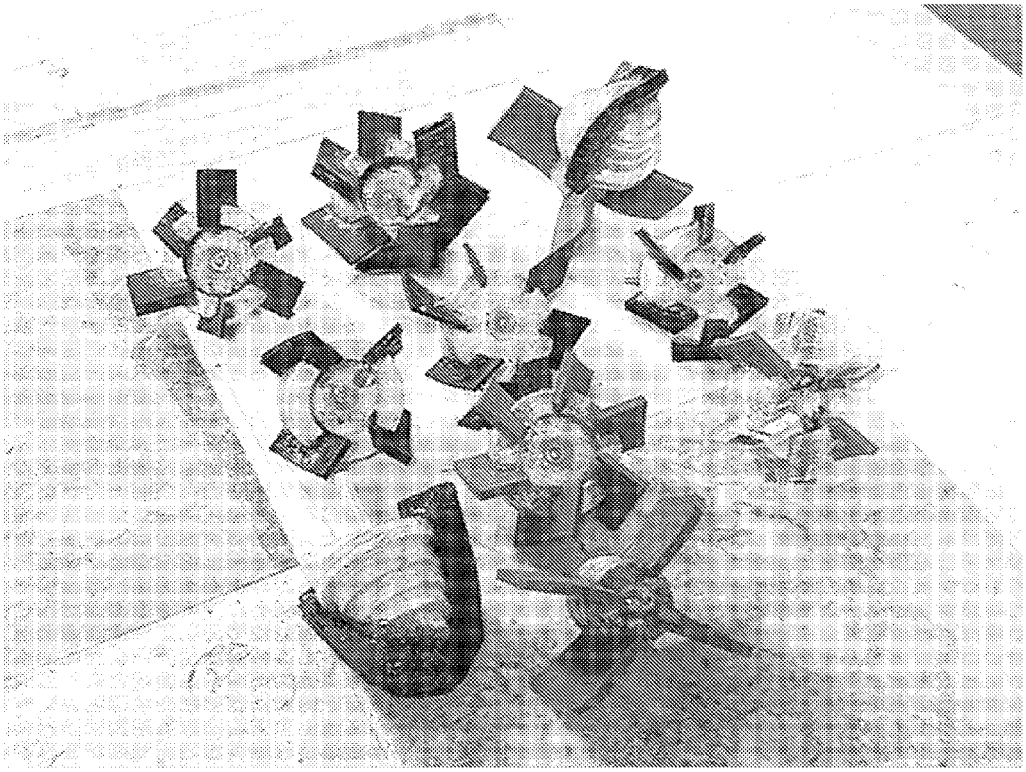
FIG. 21 is a photograph illustrating a variety of alternative debris augers.

Also, FIG. 21 illustrates various additional non-limiting examples of debris augers.

Figure 15:
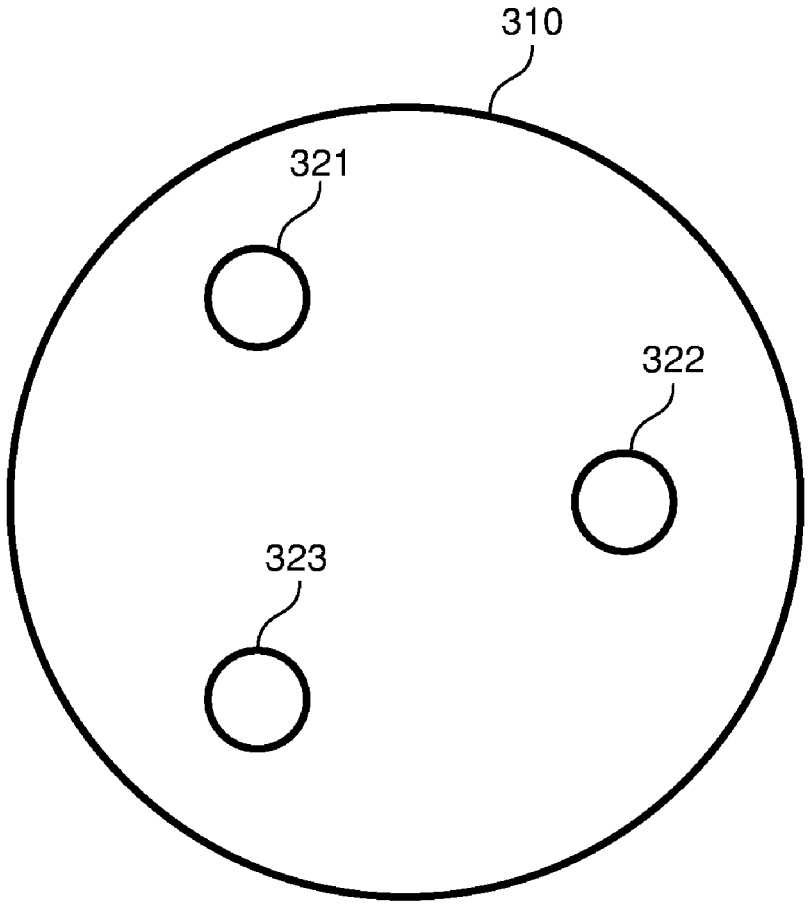
FIG. 15 is a front aspect view of a debris auger connector.

The debris auger 350 may be non-interchangeably connected to the gutter cleaning robot 10, by forming the debris auger 350 integrally with the gutter cleaning robot 10 or by permanently affixing the debris auger 350 to the gutter cleaning robot 10 by welding or using adhesives, for example. Preferably, however, the debris auger 350 is detachably and interchangeably connectable to the gutter cleaning robot 10. As shown in FIG. 15, the debris auger 350 may include a debris auger connector 310 disposed on a gutter cleaning robot 10—facing end of the debris auger 350. The debris auger connector 310 includes one or more concavities, such as first, second and third concavities 321, 322, 333, for example.

Figure 16:
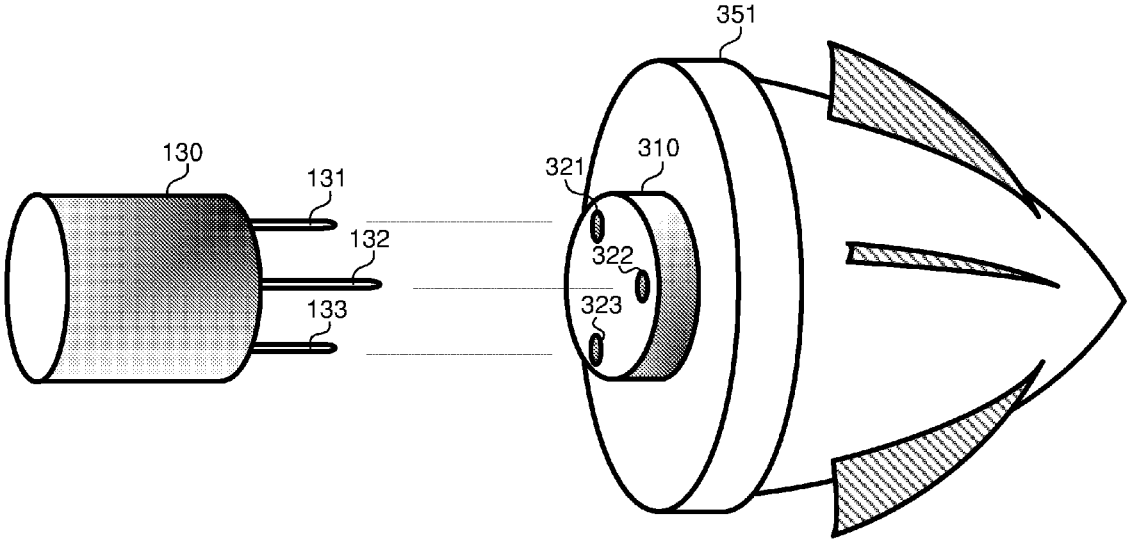
FIG. 16 is a perspective view of a debris auger 350 and a robot connector.

FIG. 16 illustrates a conical screw-with-sweeping-flaps-type debris auger 351 having a debris auger connector 310 for interfacing with a corresponding robot connector 130 disposed on the gutter cleaning robot 10 (for example, the robot connector 130 may be provided as part of, and/or at the distal end of, the debris auger shaft 163). The robot connector 130 includes one or more protrusions, such as first, second and third protrusions 131, 132, 133 that each extend into a respective concavity 321, 322 or 323 in the debris auger connector 310.

Figure 17:
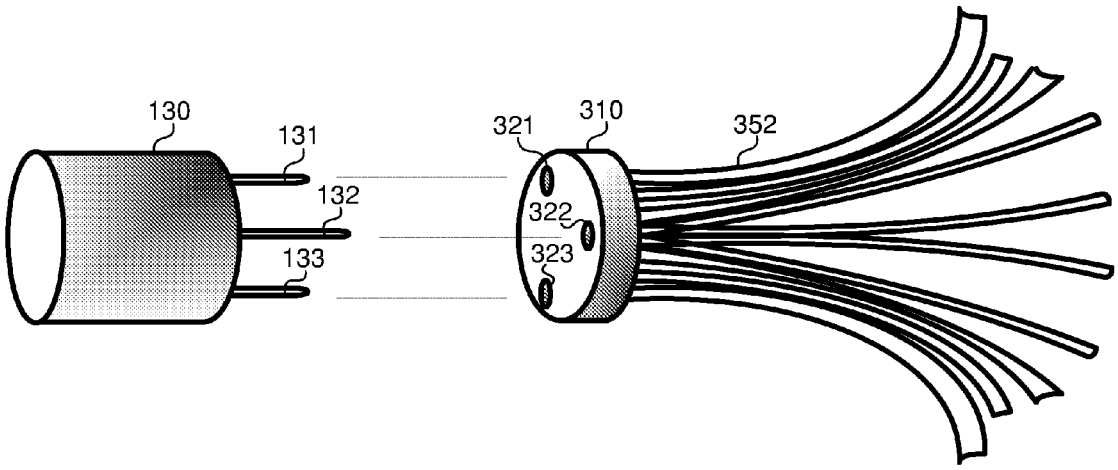
FIG. 17 is a perspective view of a debris auger 350 having flails and a debris auger connector.
Figure 18:
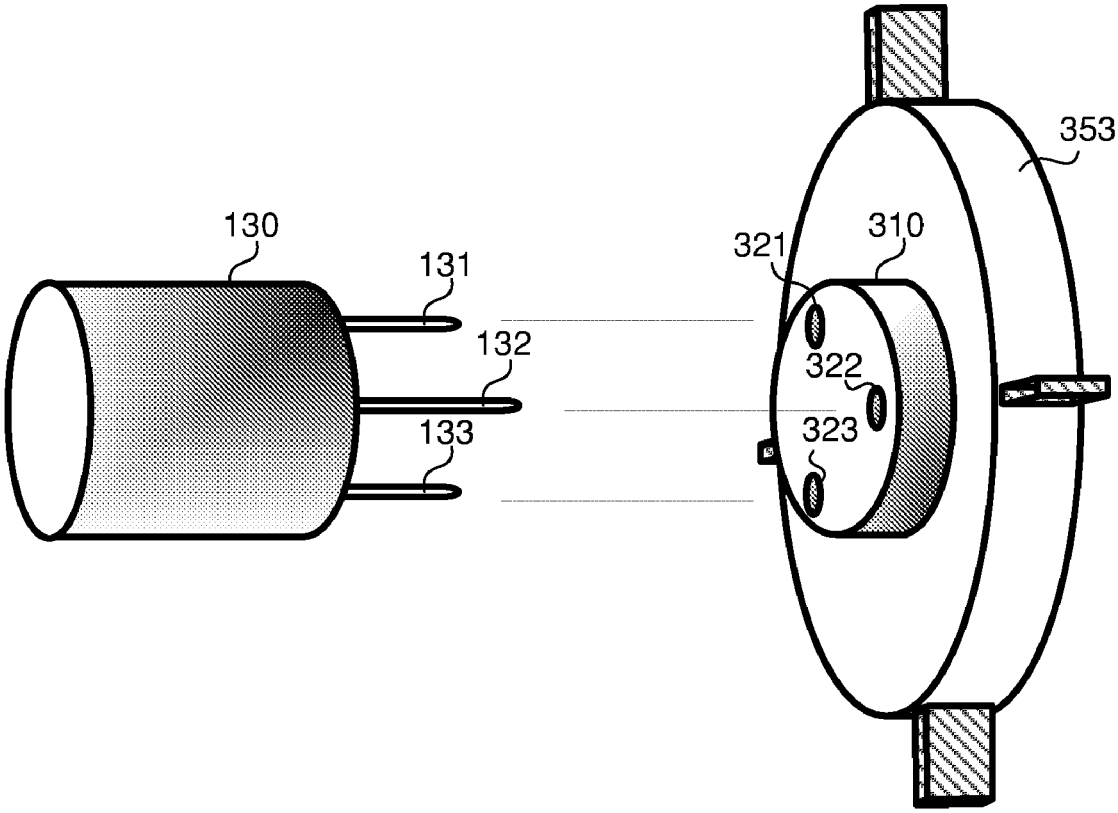
FIG. 18 is a perspective view of a debris auger 350 having longitudinal flaps and a debris auger connector.

When the debris auger 351 is affixed to the gutter cleaning robot 10, the protrusions of the robot connector 130 impart rotating force against the inner surfaces of the concavities of the debris auger connector 321, thus motivating the debris auger 361. FIG. 17 shows another example, in which a flail-type debris auger 352 includes a debris auger connector 310; and FIG. 18 illustrates an example of a flap-type debris auger 353 having a debris auger connector 310.

Figure 19:
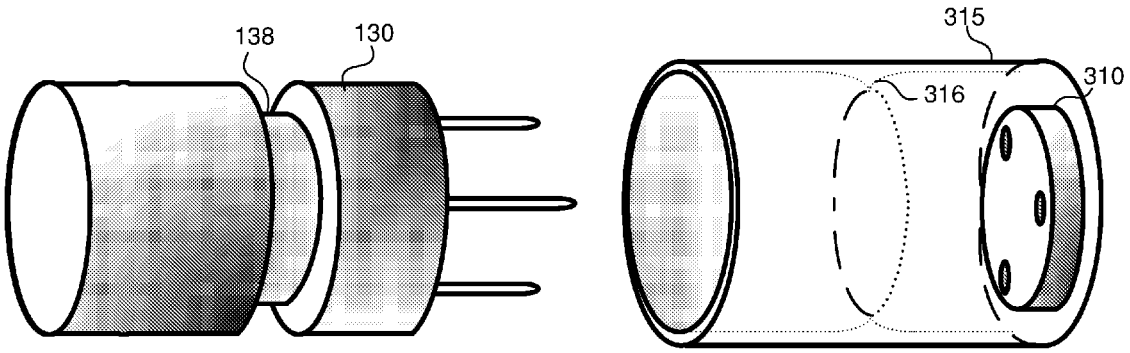
FIG. 19 is a partial cutaway view of an alternative debris auger connector having a locking shroud with a locking protrusion.

In accordance with another embodiment, a shroud 315 may be provided surrounding the debris auger connector 310. As shown in FIG. 19, the shroud 315 may extend outward from the surface onto which the debris auger connector 310 is disposed, so as to envelope or extend over the robot connector 130 when the debris auger 350 is connected to the gutter cleaning robot 10.

The shroud 315 may further include an annular locking protrusion 316 extending partially inward toward the central longitudinal axis of the shroud 315, with the robot connector 130 correspondingly including a locking collar concavity 138 disposed therealong. When the debris auger 350 having the shroud 315 is attached to the gutter cleaning robot 10, the annular locking protrusion 316 flexibly extends into the locking collar concavity of the robot connector 130, thus tending to retain the debris auger 350 in connection with the gutter cleaning robot 10 until force sufficient to dislodge the annular locking protrusion 316 out of the locking collar concavity 136 is applied to separate the debris auger 350 from the gutter cleaning robot 10.

FIG. 23 illustrates a suspension of the gutter cleaning robot 10. The rear wheels 175 are obliquely angled with regard to the vertical axis, in order to wedge the rear wheels 175 against the side and/or bottom surfaces of the gutter and improve tractional contact therebetween. Also, a spring suspension may further be provided to permit the rear wheels 175 (driven by the drive motor 170) to remain in frictional contact with the gutter 51 even when the main body 101 is jolted during a cleaning operation. Accordingly, even when the gutter cleaning robot 10 encounters a section of gutter 51 having a hole at the bottom where the drain spout 52 connects to the gutter 51, the gutter cleaning robot 10 can nonetheless safely traverse the hole.

Figure 25:
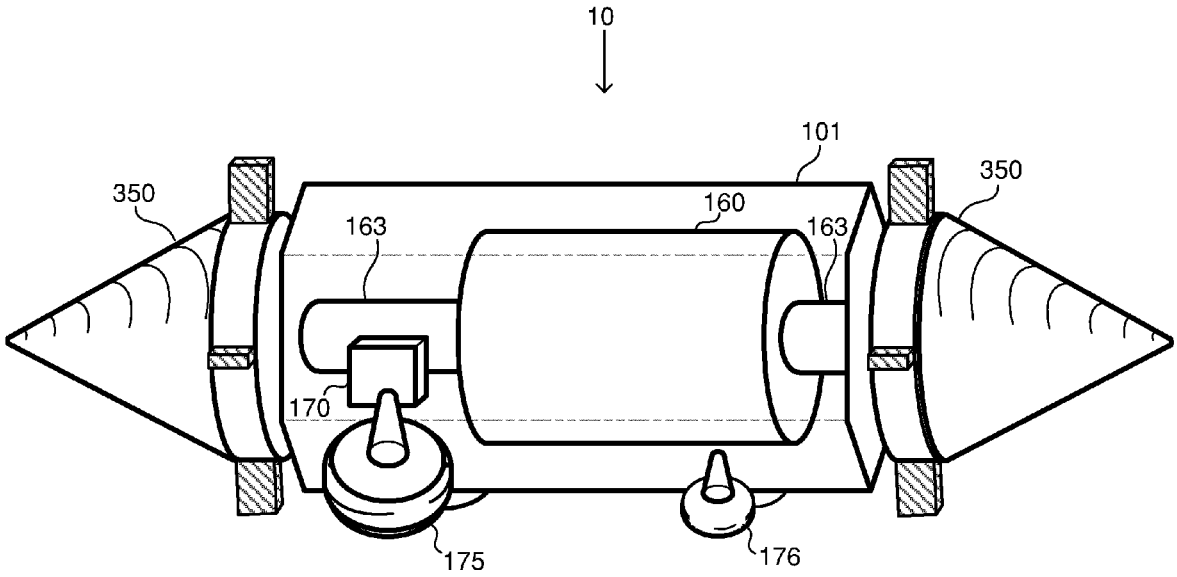
FIG. 25 is a partial cutaway view of a gutter cleaning robot having a debris auger disposed on two longitudinal ends thereof.

In accordance with another embodiment, the gutter cleaning robot 10 may include a debris auger shaft 163 that extends both to the front and rear end portions of the main body 101. Accordingly, as illustrated in FIG. 25, a debris auger 350 may be affixed to either end (or even both ends simultaneously) of the gutter cleaning robot 10. Accordingly, in this embodiment, the user can detach the debris auger 350 from one end of the gutter cleaning robot 10 and attach it to the opposite end, without having to remove the gutter cleaning robot 10 from the rain gutter 51, for example.

Figure 27:
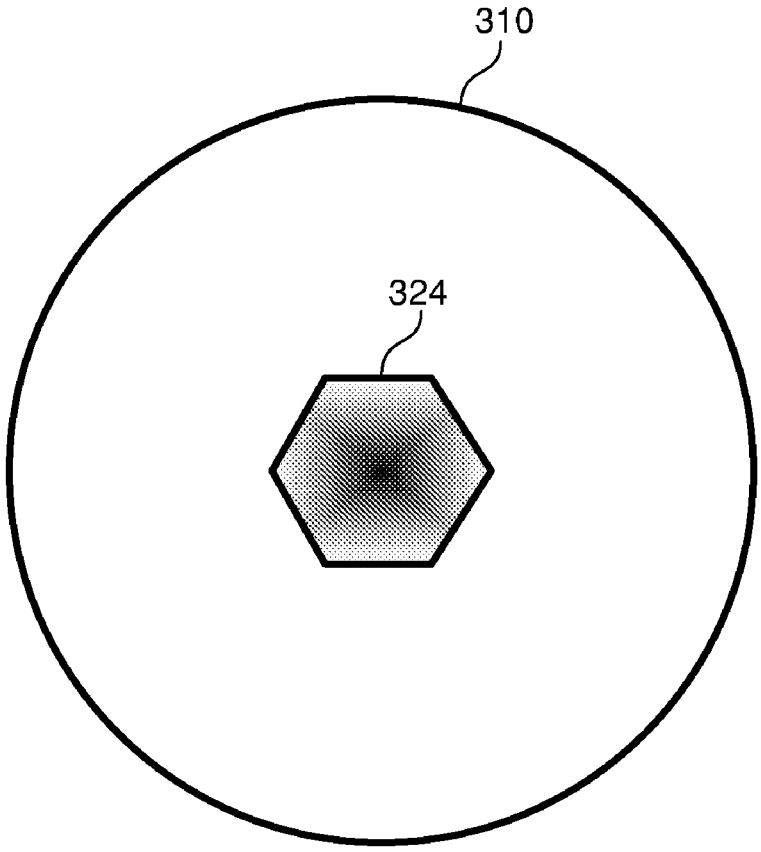
FIG. 27 is a front aspect view of a debris auger connector having a hexagonal concavity.
Figure 28:
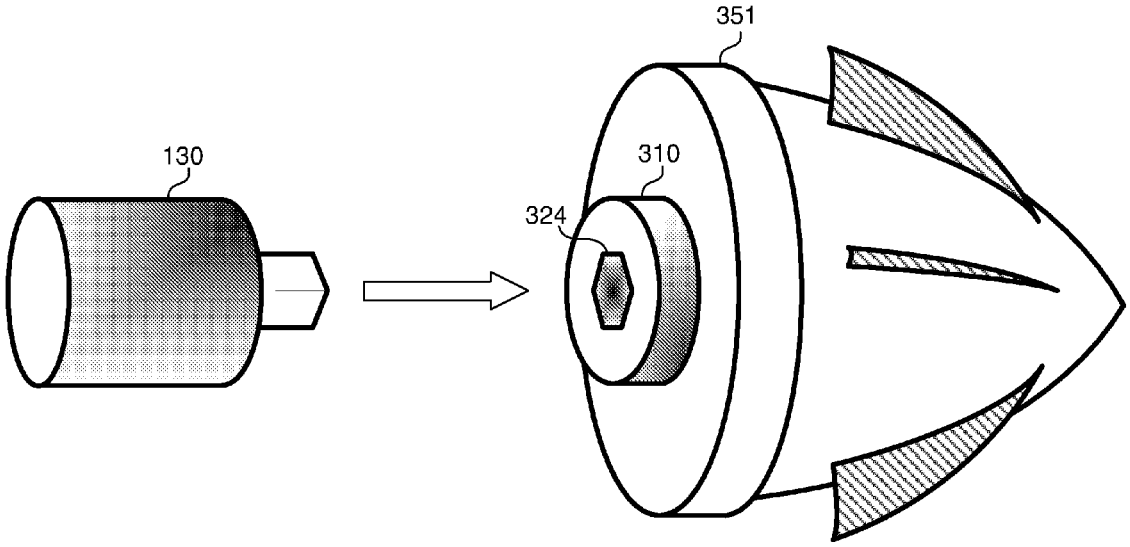
FIG. 28 is a perspective view of a debris auger connector having a hexagonal concavity and a robot connector having a hexagonal protrusion.

As shown in FIG. 27, the debris auger connector 310 may include a single concavity 324 that preferably has an outline suitable for imparting rotational force to the debris auger connector 310. The debris auger connector 310 in the example of FIG. 27 has a hexagonal concavity 324. FIG. 28 illustrates a robot connector 130 that has a single hexagonal protrusion for inserting into the hexagonal concavity 324 of the debris auger connector 310.

The gutter cleaning robot 10 may operate entirely under the control of the user using a remote control 6; alternatively, the gutter cleaning robot 10 may operate autonomously or semi-autonomously. For example, the gutter cleaning robot 10 may include an on-board controller that executes a control routine for modulating the forward motion of the gutter cleaning robot 10 through the gutter 51. The gutter cleaning robot 10 may include sensors and monitors, such as an ammeter for monitoring the drive current provided to the drive motor 160 and/or the debris auger 350 current provided to the debris auger motor 170.

Figure 29:
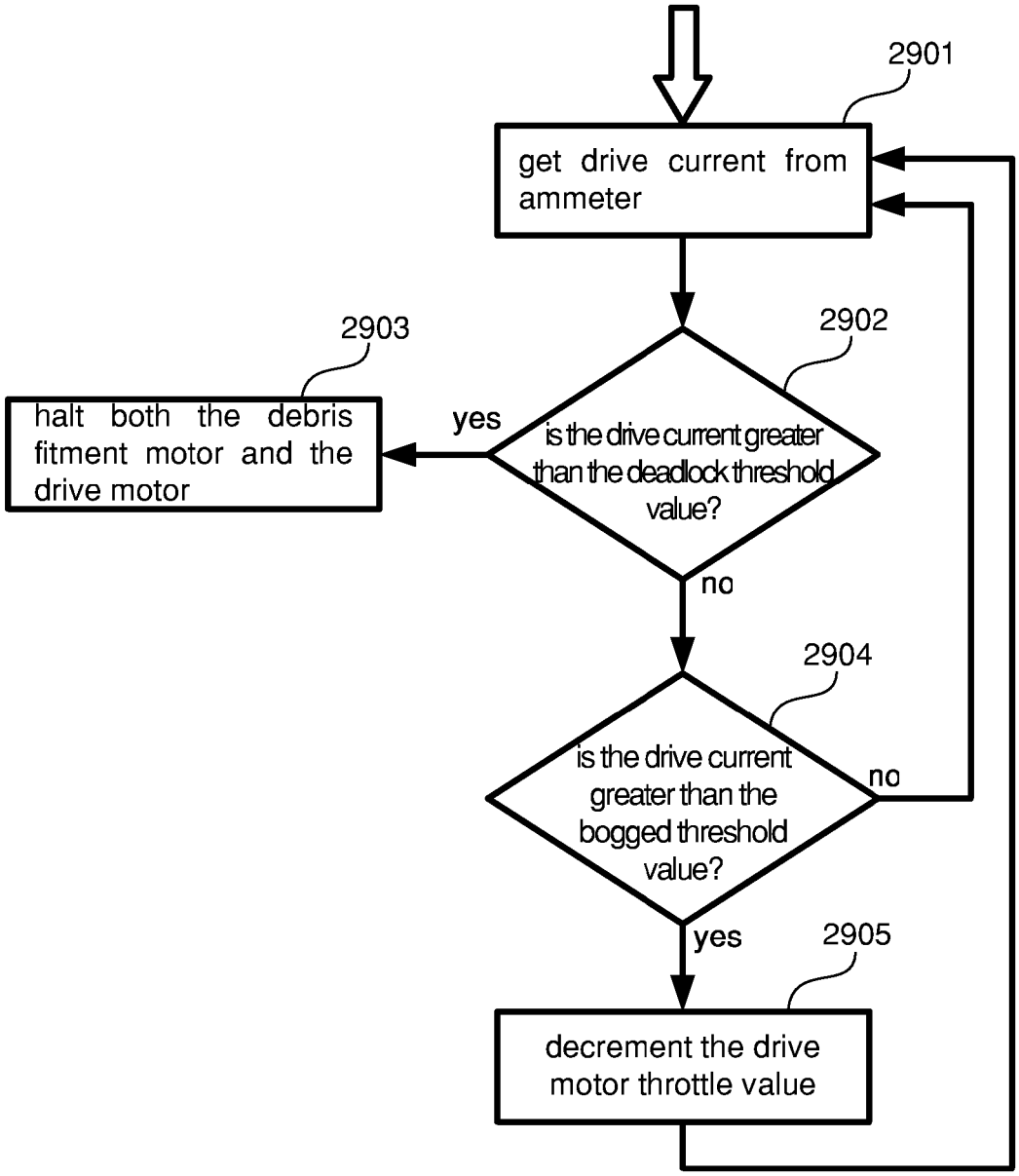
FIG. 29 is a flowchart illustrating a method for controlling the drive motor and debris auger.

FIG. 29 illustrates a method for controlling the drive motor 160 and the debris auger motor 170 in response to a mechanical drive resistance as ascertained by an ammeter monitoring the drive current supplied to the drive motor 160. At step 2901, the routine ascertains the drive current from the ammeter (for example, by reading a memory-mapped register that is updated by the ammeter). If step 2902 determines that the drive current exceeds a deadlock threshold current value (which corresponds to a drive current high enough to indicate that the gutter cleaning robot 10 is futilely attempting to proceed against an obstacle that prevents any forward motion by the gutter cleaning robot 10), then step 2903 halts both the drive motor 160 and the debris auger motor 170 in order to prevent burnout or damage to the gutter cleaning robot 10 or debris auger 350.

Otherwise, step 2904 determines whether the drive current exceeds a bogged threshold (that is, a threshold current value corresponding to a state in which the gutter cleaning robot 10 can proceed, but only slowly because of copious debris 91 in the gutter 51, referred to as being "bogged"). If not, the routine returns to step 2901; otherwise, step 2905 reduces the commanded drive speed of the drive motor 160.

Accordingly, the example method illustrated in FIG. 29 monitors the drive current and appropriately responds to obstacles or resistance encountered when traversing the gutter 51—if the gutter cleaning robot 10 is entirely prevented from moving forward, then the gutter cleaning robot 10 is halted so that the user can remedy the situation; if instead the gutter cleaning robot 10 is moving forward, albeit slowly, then the gutter cleaning robot 10 reduces the commanded velocity of traversal.

The gutter cleaning robot 10 may perform an escape behavior when triggered by appropriate sensor conditions. For example, the operating speed and/or direction of the drive motor 170 and/or the auger motor 160 may be repeatedly or cyclically shifted, in order to agitate or break free of an obstacle. Tables 1 illustrates various current sensor conditions and example escape behavior responses:

TABLE 1

| Circumstances | Drive Motor Current | Auger Motor Current | Action/Response |
|---|---|---|---|
| Auger and Wheels stuck | current > TH | current > TH | Spin both the wheels and the auger quickly in a direction opposite to the direction of movement |
| Auger is stuck | current <= TH | current > TH | Spin the auger quickly in a direction opposite to the direction of movement |
| Wheels are stuck | current > TH | current <= TH | Spin the wheels quickly in a direction opposite to the direction of movement |

When the gutter cleaning robot 10 has already performed an escape behavior but the triggering sensor conditions have not been resolved after an appropriate length of time, the gutter cleaning robot 10 may then perform a panic behavior as a second level response. Table 1 illustrates example panic behaviors that may be performed in response to various conditions:

TABLE 2

| Circumstances | Drive Motor Current | Auger Motor Current | Previous Behaviors Used | Present Action/Response |
|---|---|---|---|---|
| Auger/Wheels stuck | current > TH | current > TH | Behavior: Spinning both the wheels and the auger quickly in a opposite direction. Duration: Executed six times-three times forward and three times backward. | Power down the device and alert the user. |
| Auger is stuck | current <= TH | current > TH | Behavior: Spinning the auger quickly in an opposite direction. Duration: Executed six times-three times forward and three times backward. | Spin the drive motor in an opposite direction. Then spin the auger motor in 10 quick bursts of forward and backward movement. |
| Wheels are stuck | current > TH | current <= TH | Behavior: Spinning the wheels quickly in an opposite direction. Duration: Executed six times-three times forward and three times backward. | Power down the device and alert the user. |

What is claimed is:

1. A gutter cleaning robot, comprising:

a drive system configured to propel the gutter cleaning robot along a rain gutter, the drive system comprising a drive motor;

a debris auger detachably connected to the gutter cleaning robot and configured to agitate debris out of the rain gutter;

a debris auger motor mechanically couplable to the debris auger;

an ammeter configured to monitor an auger current supplied to the debris auger motor; and a controller configured to receive input from the ammeter and to control the drive motor and the debris auger motor, wherein the controller is further configured to modulate the drive motor when the auger current exceeds a threshold value.

2. The gutter cleaning robot according to claim 1, further comprising:

a main body including a robot connector configured to mechanically drive the debris auger; and a debris auger connector disposed on the debris auger and configured to interface with the robot connector.

3. The gutter cleaning robot according to claim 2, wherein the debris auger connector includes a plurality of connector concavities extending into the debris auger connector, each connector concavity aligned substantially parallel to a longitudinal axis of the debris auger connector, and wherein the robot connector includes a plurality of tines each configured to extend into a respective connector concavity of the debris auger connector.

4. The gutter cleaning robot according to claim 2, wherein the robot connector further includes a locking collar concavity, wherein the debris auger further includes a shroud disposed around the debris auger connector, the shroud configured to envelope the robot connector when the debris auger is attached to the main body of the gutter cleaning robot, wherein the shroud includes a locking protrusion extending from an inner surface of the shroud and configured to engage the locking collar concavity of the robot connector.

5. The gutter cleaning robot according to claim 2, wherein the debris auger connector includes a hexagonal concavity extending into the debris auger connector, the hexagonal concavity aligned substantially parallel to a longitudinal axis of the debris auger connector, and wherein the robot connector includes a hexagonal protrusion configured to extend into the hexagonal concavity of the debris auger connector.

6. The gutter cleaning robot according to claim 2, wherein first and second front wheels are disposed on opposite lateral sides of the main body of the gutter cleaning robot and configured to guide the gutter cleaning robot along the rain gutter, and first and second rear wheels disposed on opposite lateral sides of the main body of the gutter cleaning robot and operably connected to the drive motor.

7. The gutter cleaning robot according to claim 1, wherein the debris auger is interchangeable with anyone of a plurality of alternative debris augers.

8. The gutter cleaning robot according to claim 1, wherein the debris auger includes an auger configured to drill into debris.

9. The gutter cleaning robot according to claim 8, wherein the debris auger includes one or more selected from the group consisting of: a flail-type auger, a bristle-type auger, a flap-type auger, a twisting flap-type auger, an irregular protrusion-type auger, a revolving horizontal tines-type auger, a screw-and-flaptype auger, a plow-type auger, or a pneumatic auger.

10. The gutter cleaning robot according to claim 1, further comprising a remote control configured to operate the gutter cleaning robot via a wireless signal transmitted to the gutter cleaning robot.

11. The gutter cleaning robot according to claim 10, further comprising:

a first light emitting diode disposed on the remote control and configured to blink when the remote control transmits a signal; and a second light emitting diode disposed on the gutter cleaning robot and configured to blink when the gutter cleaning robot receives a signal.

12. A gutter cleaning robot, comprising:

a drive motor;

a debris auger movable to agitate debris out of a rain gutter;

a debris auger motor mechanically couplable to the debris auger;

an ammeter in electrical communication with the debris auger motor to monitor a current supplied to the debris auger motor; and a controller in electrical communication with the ammeter to receive a signal representative of the auger current, wherein the controller is configured to control the drive motor and the debris auger motor, and modulate the drive motor based at least in part on a threshold value of the auger current.

13. The gutter cleaning robot according to claim 12, wherein first and second front wheels are disposed on opposite lateral sides of the main body of the gutter cleaning robot and configured to guide the gutter cleaning robot along the rain gutter, and first and second rear wheels disposed on opposite lateral sides of the main body of the gutter cleaning robot and operably connected to the drive motor.

14. The gutter cleaning robot according to claim 12, wherein the controller is further configured to halt the drive motor and the debris auger motor based at least in part on the signal received from the ammeter.

* * * * *